US007539439B2

(12) United States Patent
Saito et al.

(10) Patent No.: US 7,539,439 B2
(45) Date of Patent: May 26, 2009

(54) IMAGE CARRIER TONER UNIT AND IMAGE FORMING APPARATUS

(75) Inventors: Masanori Saito, Tokyo (JP); Nekka Matsuura, Kanagawa (JP); Nobuyuki Yanagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 140 days.

(21) Appl. No.: 11/616,488

(22) Filed: Dec. 27, 2006

(65) Prior Publication Data

US 2007/0154235 A1 Jul. 5, 2007

(30) Foreign Application Priority Data

| | | |
|---|---|---|
| Jan. 5, 2006 | (JP) | 2006-000467 |
| May 24, 2006 | (JP) | 2006-144106 |
| Jun. 26, 2006 | (JP) | 2006-174771 |

(51) Int. Cl.
*G03G 21/18* (2006.01)

(52) U.S. Cl. ..... 399/113; 399/116

(58) Field of Classification Search ..... 399/113, 399/110, 125, 116, 24, 25, 26
See application file for complete search history.

(56) References Cited

U.S. PATENT DOCUMENTS

| | | | | |
|---|---|---|---|---|
| 5,742,319 | A * | 4/1998 | Fukunaga et al. | 399/113 X |
| 6,832,061 | B2 * | 12/2004 | Saito et al. | 399/111 |
| 2002/0037178 | A1 | 3/2002 | Saitoh et al. | 399/110 |
| 2003/0049045 | A1 * | 3/2003 | Sano et al. | 399/111 |
| 2005/0002686 | A1 | 1/2005 | Saitoh et al. | 399/110 |
| 2006/0204277 | A1 | 9/2006 | Saito et al. | 399/116 |
| 2006/0216063 | A1 * | 9/2006 | Okoshi | 399/111 |

FOREIGN PATENT DOCUMENTS

| | | |
|---|---|---|
| JP | 11-295952 | 10/1999 |
| JP | 2000-75733 | 3/2000 |
| JP | 2002-108171 | 4/2002 |

* cited by examiner

*Primary Examiner*—Sophia S Chen
(74) *Attorney, Agent, or Firm*—Oblon, Spivak, McClelland, Maier & Neustadt, P.C.

(57) ABSTRACT

A disclosed image carrier toner unit includes: an image carrier; a supporting member configured to be integrated with the image carrier, the supporting member supporting the image carrier; and a toner storage unit configured to be integrated with the supporting member, the toner storage unit storing toner for developing a latent image on the image carrier as a visible image, wherein the image carrier toner unit is detachably attached to a device on which the image carrier toner unit is installed.

19 Claims, 20 Drawing Sheets

IMAGE CARRIER TONER UNIT AND IMAGE FORMING APPARATUS

BACKGROUND OF THE INVENTION

1. Field of the Invention

The present invention generally relates to an image carrier toner unit and an image forming apparatus and more particularly to a replaceable image carrier toner unit and an image forming apparatus having the image carrier toner unit such as a copying machine, a printer, a facsimile machine, and the like.

2. Description of the Related Art

Patent Document 1 discloses what is called a process cartridge in which at least one of a development device as an imaging unit, a charging device, a cleaning device, and the like, are integrally formed and the process cartridge is detachable from an image forming apparatus.

Such a process cartridge has a merit in that a user is readily capable of replacing or maintaining the process cartridge without help of service-providing experts. In other words, in order to position the imaging unit around a photoconductor, the process cartridge is constructed such that the photoconductor, a container of a cleaning device rotatably supporting the photoconductor, and the development device are integrated, in which a charging roller for uniformly charging the photoconductor, a cleaning blade for scraping toner residual after a toner image is transferred to paper or an intermediate transfer body, and the like are attached to the cleaning container. Such a process cartridge is detachable from the image forming apparatus and can be replaced by the user when a life of the photoconductor is ended or waste toner is full.

However, in the structure where the photoconductor and the imaging device are integrally formed, there has been a problem conventionally pointed out in that even when a portion of the photoconductor or the imaging apparatus is to be replaced, the whole process cartridge must be replaced.

On the other hand, Patent Document 2 discloses a two-station recording system. In the two-station recording system, the development device, a writing device, and a driving unit are supported by an apparatus body via a common assembling member such that positions thereof are maintained in a high precision manner. Since the development device is positioned on the apparatus body based on such a structure, the development device is configured to be a positional base (base of assembly) in an entire imaging process element. The photoconductor (or photoconductor unit) is not the apparatus body but is embedded in the development device. In other words, the photoconductor (or photoconductor unit) is positioned on the development device based on a relationship where the development device is a main element and the photoconductor (or photoconductor unit) is a subordinate element. And, the photoconductor (or photoconductor unit) is detachably attached to the development device, so that the photoconductor (or photoconductor unit) is solely detachable. Further, the development device is also detachably attached to the image forming apparatus. In addition, in an embodiment, a photoconductor drum, a charging unit, and a cleaning unit are integrated.

In recent years, demands for image forming apparatuses such as printer, copying machines, and the like in the market have been increasingly complicated and sophisticated. In accordance with this, loading of the imaging device in image forming is increased. It has been understood that the demands in the market are further adding load to the imaging unit, particularly to the photoconductor. This is described from three factors in the following.

1. Miniaturization of Photoconductors Along with Miniaturization of Image Forming Apparatuses In recent years, there have been demands for miniaturization of OA machines in the market. In accordance with this, imaging devices are required to be downsized. However, when photoconductors are downsized, namely, diameters thereof are reduced, consumption of the photoconductor per sheet is increased when an image is formed under the same conditions. For example, when the diameter of the photoconductor is reduced from 120 mm to 40 mm, the photoconductor must be rotated three times the photoconductor whose diameter is 120 mm so as to form an image of the same size. Accordingly, various types of consumption the photoconductor receives upon image forming, electric consumption from discharge at a charging unit, for example, and mechanical consumption from a blade at a cleaning unit become three times.

Conventionally, although development devices and the like have been miniaturized to some extent, photoconductors have not been miniaturized in comparison with other imaging devices in order to avoid the above-mentioned consumption, for example. However, with the increasing demands for miniaturization, it is impossible to avoid the miniaturization of photoconductors. In this manner, the demands for miniaturization increase load on photoconductors and reduce life thereof.

2. Thin Film Forming for Photoconductors Along with Achievement of High Image Quality In recent years, users have increasingly output documents of photographic images and graphic documents. In accordance with this, high image quality has been developed for the purpose of achieving image quality of silver halide photography. However, upon realizing high resolution in electrophotography, the photoconductor is required to be a thin film. For example, in a case of a negatively-charged photoconductor, carriers formed by exposure in a CGL (Charge Carrier Generation Layer) pass through a CTL (Charge Carrier Transport Layer) and reach a surface of the photoconductor, thereby forming a latent image. If a thickness of the CTL is large, a length the carriers are moved is increased, so that the carriers come away from one another due to electric repulsion when the carriers are moved.

In such a case, a latent image is not formed as exactly as writing signals. As a result, an image in which dot positions are slightly displaced is formed. Such a problem is not limited to realization of high resolution in electrophotography from 600 dpi to 1200 dpi, for example. This problem is also generated upon improving image quality while the resolution is maintained to be 600 dpi so as to try to meet demands for high image quality in recent years.

In order to avoid such a case, it is necessary to make the photoconductor a thin film and reduce the movement length of carriers. Accordingly, photoconductors are made of thin films in recent years. However, the photoconductor experiences consumption due to scraping by a cleaning blade in each image forming, so that the life of the photoconductor is ended in a fewer number of image forming as the photoconductor film becomes thinner, thereby reducing the life of the photoconductor.

3. Increase of load on Photoconductor Along with Color Images

In recent years, color images have been increasingly output in the market due to readiness of comprehension of information and the like. Differing from monochrome images, in many cases, subjects to be output in color images include photographic images and graphic images occupying a wide area on paper for recording an image. Also, a solid color portion is in a background portion in many cases. In accordance with this, an imaging area upon per image forming is increased and consumption of the imaging device is increased along with the imaging area.

On the other hand, revolver type image forming apparatuses, for example, in which plural development units are employed for one photoconductor have been conventionally well known. Such image forming apparatuses are capable of forming color images at relatively a low cost as the number of parts is small. However, a latent image is developed in the photoconductor by the plural development units, so that the consumption of the photoconductor becomes several times greater than that of the development units. Thus, the consumption of the photoconductor along with color images is particularly large. Color images are one of factors in reducing the life of the photoconductor.

Patent Document 1: Japanese Laid-Open Patent Application No. 2000-075733

Patent Document 2: Japanese Laid-Open Patent Application No. 11-295952

Patent Document 3: Japanese Laid-Open Patent Application No. 2002-108171

As mentioned above, it is possible to readily estimate the life of the photoconductor relatively reduced in comparison with other imaging devices. Although researches on improvement of durability and life of photoconductors have been developed, researches on improvement of durability and life of other imaging devices have also been developed, so that the life of photoconductors tends to be relatively reduced.

This tendency causes imbalance of life in the photoconductor in the process cartridge and other imaging units. In other words, conventionally, it has been pointed out that the process cartridge has a problem in that an entire process cartridge must be replaced along with one of the imaging units with the shortest life. This problem becomes further obvious due to the reduced life of the photoconductor and a harmful effect may be caused, in which other imaging units are replaced along with the photoconductor with the shortest life.

In such a case, there are generated a financial burden for users resulting from disposition of imaging devices whose life is not ended, waste of labor of manufacturers collecting process cartridges, and negative effects on the environment. In particular, consideration for the environment is a worldwide concern and liability of manufacturers in the modern society, which must be given top priority. Process cartridges that have given priority in terms of usability must be given priority in terms of the environment.

In view of this, in order to prevent such harmful effects resulting from the demands of the recent market/society, Patent Document 3 discloses an image forming apparatus. In the image forming apparatus, it is possible to solely and preferentially replace a constituent element with a short life among plural constituent elements constituting the image forming apparatus. According to an embodiment in Patent Document 3, only a photoconductor is configured as a photoconductor cassette separately from a development unit and a cleaning unit. And, it is possible for a user to solely replace the photoconductor cassette. In addition, even in a case of plural photoconductors such as a tandem image forming apparatus, it is possible to replace each photoconductor at different replacement time. As mentioned above, Patent Document 3, in which it is possible for a user to replace each photoconductor, gives top priority to the environment and also reduces burden for users and manufacturers, so that problems regarding process cartridges are eliminated. Preferably, trouble for users is eliminated by improving usability. Further, operations the users must perform more frequently than the replacement of the photoconductor include replacement and supply of toner which is consumed greater than the photoconductor and the replacement and supply of toner lays a burden for the users. However, the users consider the replacement and supply of toner to be the same as replacement of ink of a ball-point pen or supply of staples to a stapler. Thus, although the replacement and supply of toner is troublesome, this has been taken for granted by the users. However, in addition to the replacement and supply of toner which has not been regarded as greatly bothersome, if the replacement of the photoconductor with a high replacement frequency following the toner having different replacement and supply time is added, it is naturally expected that the users are significantly dissatisfied with such inconvenience and trouble.

SUMMARY OF THE INVENTION

It is a general object of the present invention to provide an improved and useful image carrier toner unit and an image forming apparatus in which the above-mentioned problems are eliminated.

A more specific object of the present invention is to provide an image carrier toner unit and an image forming apparatus that can ease the burden for the users, manufacturers, and the environment, in which usability of replacement is considered, so as to prevent the problems resulting from the demands in the market in recent years.

According to one aspect of the present invention, there is provided an image carrier toner unit including: an image carrier; a supporting member configured to be integrated with the image carrier, the supporting member supporting the image carrier; and a toner storage unit configured to be integrated with the supporting member, the toner storage unit storing toner for developing a latent image on the image carrier as a visible image, wherein the image carrier toner unit is detachably attached to a device on which the image carrier toner unit is installed. Thus, it is possible to improve usability upon replacement operation by a user and reduce a running cost resulting from replacement. And, the burden for the environment is reduced.

According to another aspect of the present invention, in the image carrier toner unit, at least one of first portions formed using a surface of the supporting member is positioned outside relative to the image carrier. Thus, it is possible to protect a surface of the image carrier when the image carrier toner unit is detached, so that the user is capable of replacing the image carrier toner unit without paying attention.

According to another aspect of the present invention, in the image carrier toner unit, at least one of second portions formed using a surface of the toner storage unit is positioned outside relative to the image carrier. Thus, it is possible to protect the surface of the image carrier when the image carrier toner unit is detached, so that the user is capable of replacing the image carrier toner unit without paying attention.

According to another aspect of the present invention, in the image carrier toner unit, a line connecting the first portion formed using the surface of the supporting member to the second portion formed using the surface of the toner storage unit is positioned outside relative to the image carrier. Thus, it is possible to protect the surface of the image carrier when the image carrier toner unit is detached, so that the user is capable of replacing the image carrier toner unit without paying attention.

According to another aspect of the present invention, in the image carrier toner unit, the toner storage unit is formed so as to extend substantially in parallel with a rotation shaft of the image carrier. Thus, it is possible to store a large amount of toner and improve stability when the image carrier toner unit is solely placed on a floor.

According to another aspect of the present invention, in the image carrier toner unit, a time when toner stored in the toner storage unit is completely consumed from image forming and a time when life of the image carrier is ended are substantially the same by comparison or the life of the image carrier is longer. Thus, it is possible to reduce the number of replacement operations by the user and a running cost of the image carrier toner unit.

According to another aspect of the present invention, there is provided an image carrier toner unit including: an image carrier; a supporting member for rotatably supporting the image carrier; and a toner storage unit supplying toner to a development unit forming a latent image on the image carrier as a visible image, wherein the image carrier toner unit is capable of being positioned, fixed, and detached relative to a device on which the image carrier toner unit is installed. Thus, it is possible to readily replace the image carrier toner unit and maintain positional accuracy of the photoconductor and the development unit with high accuracy upon image forming greatly having an influence on image quality.

According to another aspect of the present invention, in the image carrier toner unit, at least three positioning and fixing portions are disposed for the device on which the image carrier toner unit is installed. Thus, it is possible to stably position the image carrier toner unit on the development unit with high accuracy.

According to another aspect of the present invention, in the image carrier toner unit, two of the positioning and fixing portions are disposed on the image carrier and at least one of the positioning and fixing portions is disposed on the toner storing unit. Thus, it is possible to stably position the image carrier relative to the development unit with high accuracy and to position the toner storage unit without vibration.

According to another aspect of the present invention, there is provided an image carrier toner unit comprising: an image carrier; a supporting member for rotatably supporting the image carrier; and a toner storage unit supplying toner to a development unit forming a latent image on the image carrier as a visible image, wherein the image carrier toner unit is capable of being positioned, fixed, and detached relative to a device on which the image carrier toner unit is installed and the image carrier is capable of being positioned, fixed, and detached relative to the image carrier toner unit. Thus, it is possible to readily replace the image carrier toner unit having the image carrier and it is possible to readily replace only the image carrier from the image carrier toner unit.

According to another aspect of the present invention, in the image carrier toner unit, a detachment direction of the image carrier toner unit detached relative to the device on which the image carrier toner unit is installed is substantially the same as a detachment direction of the image carrier detached relative to the image carrier toner unit. Thus, it is possible to improve operability and provide efficient operations readily understandable for the user.

According to another aspect of the present invention, in the image carrier toner unit, the image carrier is detachable while the image carrier toner unit is positioned and fixed on the device. Thus, it is possible to replace only the image carrier without detaching the image carrier toner unit and it is possible to further readily replace the image carrier.

According to another aspect of the present invention, in the image carrier toner unit, the image carrier toner unit when the image carrier is detached is detachably attached to the device. Thus, it is possible to flexibly deal with a case where the image carrier toner unit from which the image carrier is detached must be replaced due to unexpected situations or the like.

According to another aspect of the present invention, in the image carrier toner unit, a portion is provided such that a base portion of installation for the image carrier and a base portion of installation for the device are disposed on the same location. Thus, it is possible to determine relative position of the image carrier and the device with high accuracy and to reduce vibration of the image carrier toner unit upon replacing the image carrier.

According to another aspect of the present invention, in the image carrier toner unit, the base portion of installation for the device is disposed on the image carrier and the toner storage unit. Thus, it is possible to reduce vibration of the image carrier toner unit upon replacing the image carrier.

According to another aspect of the present invention, there is provided an image forming apparatus on which the above-mentioned image carrier toner unit is installed. Thus, it is possible to provide an image forming apparatus in which the usability of replacement in terms of consumable elements, running cost, and environmental burden is considered.

According to another aspect of the present invention, in the image forming apparatus, a development unit for forming a toner image on the image carrier is included and the toner storage unit of the image carrier toner unit is positioned above the development unit. Thus, self-weight of the toner is used for falling, so that the toner supply is smoothly performed without requiring additional units or parts.

According to another aspect of the present invention, in the image forming apparatus, the image carrier toner unit is capable of being detached upward. Thus, it is possible to detach the image carrier toner unit while maintaining status and position thereof while maintaining a status or position when installed on the image forming apparatus, and usability in terms of replacement is improved.

According to another aspect of the present invention, in the image forming apparatus, a replacement time of the image carrier toner unit is determined in accordance with a time when toner of the toner storage unit of the image carrier toner unit is completely consumed. Thus, it is possible to reduce the running cost of the image carrier toner unit and use a modestly priced conventional image carrier since the image carrier of the image carrier toner unit may have a short life.

According to another aspect of the present invention, in the image forming apparatus, among constituent elements of imaging units constituting the image forming apparatus, the image carrier toner unit is capable of being detached first. Thus, it is possible to improve efficiency of replacement of the image carrier toner unit having a high replacement frequency and usability of the image carrier toner unit.

According to another aspect of the present invention, in the image forming apparatus, among constituent elements of imaging units constituting the image forming apparatus, the image carrier of the image carrier toner unit is capable of being detached first. Thus, it is possible to improve efficiency when only the image carrier is replaced and usability of the image carrier.

According to another aspect of the present invention, in the image forming apparatus, plural image carrier toner units mentioned above in which toner of different color is stored in each toner storage unit are installed. Thus, it is possible to provide a color image forming apparatus in which the usability of replacement in terms of consumable elements, running cost, and environmental burden is considered.

According to the image carrier toner unit of the present invention, the image carrier and toner having high consumption are integrated and replaceable as the image carrier toner unit. Upon replacing the image carrier toner unit, it is possible to eliminate the necessity of replacing other imaging units together with the image carrier toner unit, improve efficiency of operation upon replacement by the user, and reduce the running cost resulting from replacement. Further, it is possible to reduce the burden for the environment since the replacement of each imaging unit is performed without waste.

Other objects, features and advantage of the present invention will become more apparent from the following detailed description when read in conjunction with the accompanying drawings.

DETAILED DESCRIPTION OF THE PREFERRED EMBODIMENTS

In the present invention, a photoconductor and a toner storage unit storing toner so as to supply toner to a development device are integrated and can be replaced as a toner unit. By integrating the toner with the photoconductor to be replaceable at the same time, the toner and the photoconductor being consumable and having a high replacement frequency in comparison with other consumable imaging devices, it is possible to reduce the financial burden for the users and the waste of labor for collection by manufacturers, and to eliminate inconvenience or trouble the users experience upon replacement without generating negative effects on the environment. However, although both elements have a high replacement frequency, there is a difference between the life of the photoconductor and a degree of consumption of the toner, so that it is difficult to have the same replacement time for both elements without any measures. In order to further improve a percentage of completion of the unit, it is necessary to take measures such that a time when the life of the photoconductor is ended and a time when toner of the toner storage unit is completely consumed are close to each other as much as possible. Such methods may be considered as the following two methods; a method for defining capacity of the toner storage unit such that the capacity corresponds to the life of the photoconductor and a method for using materials of the photoconductor such that the life of the photoconductor corresponds to the capacity of the toner storage unit. In order to have the capacity of the toner storage unit in accordance with the photoconductor having a longer life, it is necessary to increase the capacity to about at least dozens of times. However, a size of the image forming apparatus is limited and the increase of the capacity is also limited. Thus, it is not realistic to increase the capacity of the toner storage unit in accordance with the photoconductor. This is still difficult even waste toner is reused or a transfer rate is 100%. By contrast, it is realistic to use a photoconductor having life in accordance with the capacity of the toner storage unit, since a photoconductor with a shorter life may be used and it is not necessary to develop any type of novel materials for the photoconductor. This is capable of handling factors in reducing the life of the photoconductor (load accompanied by the miniaturized photoconductor, thin film, and color images) and meeting the demands in the market or social trends. However, in practice, the life of the photoconductor may be somewhat longer than the time when the toner of the toner storage unit is completely consumed taking into consideration safety.

Figure 1:
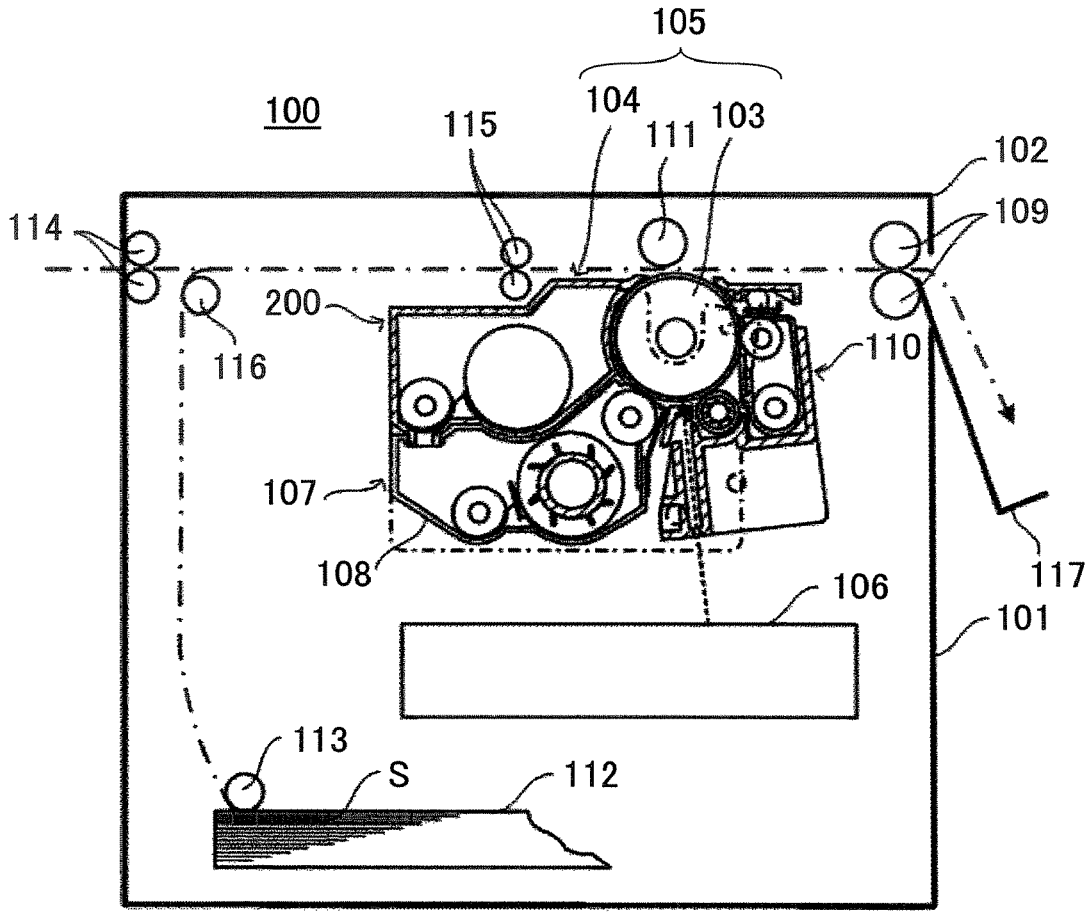
FIG. 1 is a schematic cross-sectional view showing a structure of an image forming apparatus according to an embodiment of the present invention.

FIG. 1 is a schematic cross-sectional view showing a structure of an image forming apparatus according to an embodiment of the present invention. The image forming apparatus shown in FIG. 1 is the same as an electrophotographic image forming apparatus for monochrome images. In FIG. 1, an image forming apparatus 100 according to the embodiment of the present invention includes a lower enclosure 101 and an upper enclosure 102. In the lower enclosure 101, there are disposed a photoconductor toner unit 105 formed by integrating a photoconductor 103 as an image carrier for mainly forming/carrying a toner image with a toner storage unit 104 storing toner, a writing unit 106 forming an electrostatic latent image on the photoconductor 103, a development device 108 of a development unit 107, the development device 108 forming a toner image by attaching toner to the electrostatic latent image formed on the photoconductor 103 by the writing unit 106, a fixing device 109 for fixing the toner image transferred to transfer paper S, a cleaning unit 110 for cleaning toner residual on the photoconductor 103 after the transfer, and the like. Further, in the upper enclosure 102, there are disposed a transfer roller 111 for transferring the toner image to the transfer paper S at a transfer position, the toner image being formed by the development device 108, and the like. In the present embodiment, the photoconductor toner unit 105 and the cleaning unit 110 are installed on the development unit 107 and each unit is configured to be separately detachably attached to the development unit 107. The development unit 107 is configured to be detachably attached to the lower enclosure 101. A collective body of the three of the development unit 107 as a central unit, the photoconductor toner unit 105, and the cleaning unit 110 is referred to as an image station 200.

In this manner, the image forming apparatus of the present invention is constituted such that there are disposed a paper feed cassette 112 for storing transfer paper S, a paper feed runner 113, the writing unit 106, the image station 200 including the development unit 107, the photoconductor toner unit 105, and the cleaning unit 110, the transfer roller 111, the fixing device 109, and the like, in an overlapping manner. In an upper portion of the image forming apparatus 100, there are formed substantially vertical and horizontal paper conveying paths including a pair of rollers 114 for manual feeding disposed on the left side of the upper portion and a pair of register rollers 115 disposed immediately before the transfer position, and the like. The transfer paper S is picked up using the paper feed runner 113 from the paper feed cassette 112 and sent upward. Then, the transfer paper S is turned to a lateral direction at a turn roller 116 and sent to the pair of register rollers 115, the transfer roller 111, and the fixing device 109. Finally, the transfer paper S is ejected to a paper ejection unit 117. The writing unit 106 may include an optical system such as LED. In the present embodiment, the writing unit 106 employs LD as a light source and an electrostatic latent imager is formed on the photoconductor 103 of the photoconductor toner unit 105 using exposure in accordance with output image information.

Figure 2:
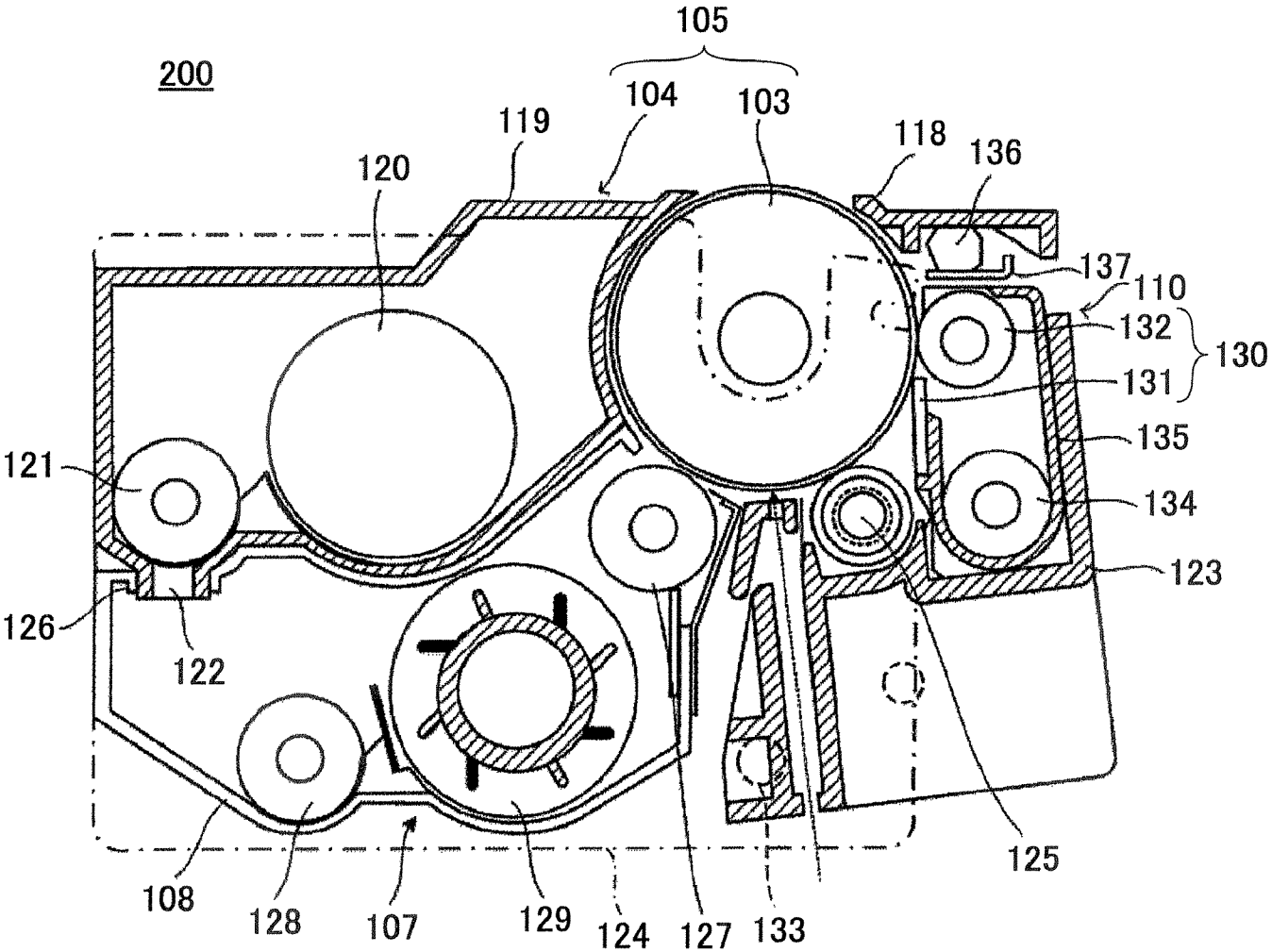
FIG. 2 is a schematic cross-sectional view showing a structure of an image station in FIG. 1.

FIG. 2 is a schematic cross-sectional view showing a structure of the image station in FIG. 1. In FIG. 1, the photoconductor toner unit 105 is described as a unit formed by integrating the photoconductor 103 with the toner storage unit 104 for ease of understanding. However, the photoconductor toner unit 105 in practice includes the photoconductor 103 and a housing 119 as an integrally molded supporting member including a holder unit 118 protecting and rotatably supporting the photoconductor 103 and the toner storage unit 104. In other words, the photoconductor toner unit 105 is a unit in which the photoconductor 103 is supported by the housing 119 having the toner storage unit 104 and the holder unit 118. Differing from a conventional process cartridge, the photoconductor is not integrated with other imaging units such as the development device, a charging unit, or the like. In the toner storage unit 104 of the photoconductor toner unit 105, unused toner for supplying the toner to the development device 108 is stored inside thereof and a stirring screw 120 for stirring and conveying toner and an ejection screw 121 for supplying and conveying toner to the development device 108 are disposed. A lump of toner is stirred and by the stirring screw 120 and ejected to the ejection screw 121 as fine powder. A direction of conveyance of the ejection screw 121 is opposite to that of the stirring screw 120, so that the toner is circulated in the inside of the toner storage unit 104. In this process, the toner is supplied to the development device 108 from a discharge outlet 122. A time when the toner is supplied is determined by a toner supply direction from a process control and toner supply is performed when a driving source not shown in the drawings is switched ON/OFF, the driving source being connected to the stirring screw 120 and ejection screw 121. Thus, when toner is not supplied, the toner in the toner storage unit 104 is not circulated. Further, when the ejection screw 121 is not rotated, the ejection screw 121 functions as a lid of the discharge outlet 122, so that the toner is not fallen to the development device 108. By disposing the toner storage unit 104 above the development device 108 as in the present embodiment, upon toner supply from the toner storage unit 104 to the development device 108, self-weight of the toner is used for falling. Thus, the toner supply is smoothly performed without requiring additional units or parts. The photoconductor 103 is connected to a motor for driving disposed on an image forming apparatus body, the photoconductor 103 being connected via a driving transfer system (not shown in the drawings) such as a gear disposed coaxially with the photoconductor 103. And the photoconductor 103 is configured to rotate in the clockwise direction. The driving motors of the photoconductor 103 and the stirring screw 120 are separate, since the photoconductor 103 must be driven with high accuracy and needs to be free from load changing factors such as toner stirring in order to avoid influences of the load changing factors. By contrast, the motor for driving the stirring screw 120 and the ejection screw 121 is not required to operate with high accuracy and the motor may have a certain torque. In addition, the stirring screw 120 may be connected to a motor for driving a development roller and transfer of driving from the motor may be switched ON/OFF using an electromagnetic clutch without driving the stirring screw 120 using a dedicated motor.

Further, the development unit 107 includes the development device 108, a unit case 123 for detachably install the cleaning unit 110, and a side plate 124, which is also a side plate of the development device 108, for protecting and supporting the development device 108 and rotatably supporting the unit case 123. In addition, a charging roller 125 is rotatably supported by the unit case 123.

Next, the development device 108 of the development unit 107 is described. The photoconductor toner unit 105 and the development device 108 are positioned by the side plate 124 with high accuracy. The development device 108 and the side plate 124 are integrated. In this status, the toner storage unit 104 as a portion of the housing 119 of the photoconductor toner unit 105 is positioned above the development device 108. In the toner storage unit 104, as mentioned above, the discharge outlet 122 disposed in a lower portion of the toner storage unit 104 is inserted into a supply inlet 126 disposed on an upper portion of the development device 108, so that toner supply is performed without scattering or leakage. In FIG. 2, a member for preventing the scattering or leakage such as a sealing member or the like is omitted. The development device 108 includes a development roller 127, a conveying screw 128 for stirring and conveying toner, and a paddle roller 129 for supplying and conveying toner to the development roller 127. Toner is supplied from the supply inlet 126 to an end of the conveying screw 128. The toner conveyed to an inside of development device 108 by the conveying screw 128 is sent by the paddle roller 129 in a direction opposite to a conveyance direction by the conveying screw 128 and circulated. In this process, the toner is supplied to the development roller 127. The development roller 127, the paddle roller 129, and the conveying screw 128 are connected to one another via a driving transfer system (not shown in the drawings) such as a gear disposed coaxially with each element or an idler gear. The development roller 127 is connected to the motor for driving disposed on the image forming apparatus 100, so that driving is transferred to the paddle roller 129 and conveying screw 128.

In this manner, in the image station 200, the development device 108 of the development unit 107, the photoconductor 103 of the photoconductor toner unit 105, a cleaning device 130 of the cleaning unit 110, and the like are positioned by the side plate 124 so that a relative position of each element is determined with high accuracy. In order to highly accurately determine the relative position between the photoconductor 103 and the development roller 127, the photoconductor toner unit 105 is configured to be positioned relative to the side plate 124 integrated with the development device 108 including the development roller 127. In order to highly accurately determine the relative position among the photoconductor 103, the cleaning device 130, and the charging roller 125, the cleaning unit 110 supporting the cleaning device 130 in the unit case 123 pivotally supporting the charging roller 125 is positioned relative to the photoconductor toner unit 105 positioned with high accuracy on the side plate 124. The cleaning unit 110 performs operations on the photoconductor toner unit 105 in a close or spaced manner using the side plate 124. The cleaning unit 110 is rotated on a fulcrum 133.

By constructing the structure of the photoconductor toner unit 105, and determining the relationships of the development device 108, the charging roller 125, and the cleaning unit 110 relative to the photoconductor toner unit 105 via the side plate 124 as mentioned above, it is possible to replace the photoconductor toner unit 105, namely, the photoconductor 103 and toner at the same time. In other words, by adjusting a time when the life of the photoconductor 103 is ended and a time when toner of the toner storage unit 104 is completely consumed such that they are close to each other as much as possible or by prolonging the life of the photoconductor 103 to some extent, it is possible to determine a replacement time of the photoconductor toner unit 105 as the time when the toner of the toner storage unit 104 is completely consumed and to replace only the photoconductor toner unit 105 at the replacement time. In this respect, the present invention is greatly different from conventional process cartridges. In the present invention, only an element which must be replaced is replaced and an element which can still be used is not replaced so as to prevent waste.

Further, the side plate 124 is detachably attached to the lower enclosure 101. In other words, it is possible to replace the development unit 107, so that it is possible to handle a case where the development device 108 must be replaced due to unexpected failure and the like. In this case, it is possible to detach the photoconductor toner unit 105 and the cleaning unit 110 from the side plate 124, so that it is possible to replace only the development device 108 and eliminate waste. Also, when failure is generated in the cleaning unit 110, the cleaning unit 110 may be detached from the unit case 123 and replaced, so that it is possible to prevent waste of the photoconductor toner unit 105 or the development device 108.

Moreover, in the image station 200 according to the present embodiment, it is possible to detach the photoconductor toner unit 105 before the development device 108 or the cleaning unit 110, so that it is possible to improve efficiency of replacement of the photoconductor toner unit 105 having a high replacement frequency. The photoconductor 103 and the toner, namely, the photoconductor toner unit 105 is a consumable element having the highest replacement frequency. Upon frequently replacing the photoconductor toner unit 105, it is troublesome and less convenient to detach the development device 108 and the cleaning unit 110 from the image forming apparatus 100 along with the side plate 124 since the development device 108 and the cleaning unit 110 are not required to be replaced and additional problems such as dirty hands or surroundings may be generated. In view of this, in order to solve such problems, according to the present invention, it is possible to detach only an element to be replaced without detaching elements that are not required to be detached. Further it is possible to preferentially detach an element having a high replacement frequency.

In the present embodiment, other cassettes or parts constituting the image forming apparatus 100 and the image station 200 are constructed based on the above-mentioned idea. In the present embodiment, although the photoconductor 103 is described as having a drum-like shape, the photoconductor 103 may be constructed to have a belt-like shape.

In the following, the life of the photoconductor 103 used to determine the replacement time of the photoconductor toner unit 105 and the capacity of the toner storage unit 104 are briefly described. Although technical advancement in materials for a photoconductor has made substantial progress in recent years and the life of a photoconductor is extended to about 400 to 500 thousand sheets, if the life of the photoconductor 103 is adjusted to the capacity of the toner storage unit 104 as mentioned above, it is not necessary to use such a long-life material for the photoconductor 103. A conventional material having a life of about dozens of thousand to 100 thousand sheets may be used. This is substantially advantageous in terms of cost. For example, when a conventional material having a life of about 20 thousand sheets is used, if a diameter of the photoconductor 103 is reduced to ½ due to a reduced diameter of the photoconductor resulting from miniaturization or reduction in weight of the apparatus, the life of the photoconductor is also reduced to ½, namely 10 thousand sheets, so that an amount of toner stored in the toner storage unit 104 is set to allow printing of about 8 thousand sheets (less that 10 thousand sheets in terms of safety) in accordance with the 10 thousand sheets. The photoconductor toner unit 105 is replaced when 8 thousand sheets have been printed. The photoconductor toner unit 105 is constructed based on the above idea.

When only the life of the photoconductor is considered, the photoconductor tends to be overused such that fatigue degradation is accelerated and this tendency has become stronger. In other words, even if the life and durability of photoconductor materials are improved, when the photoconductor is overused, it is natural that the replacement frequency is not reduced and it is estimated that the reduction of the replacement frequency is not expected in the future. The replacement frequency of the photoconductor remains to be highest in comparison with other imaging units in the same manner as in a conventional photoconductor since other imaging units have achieved a longer life.

Figure 3:
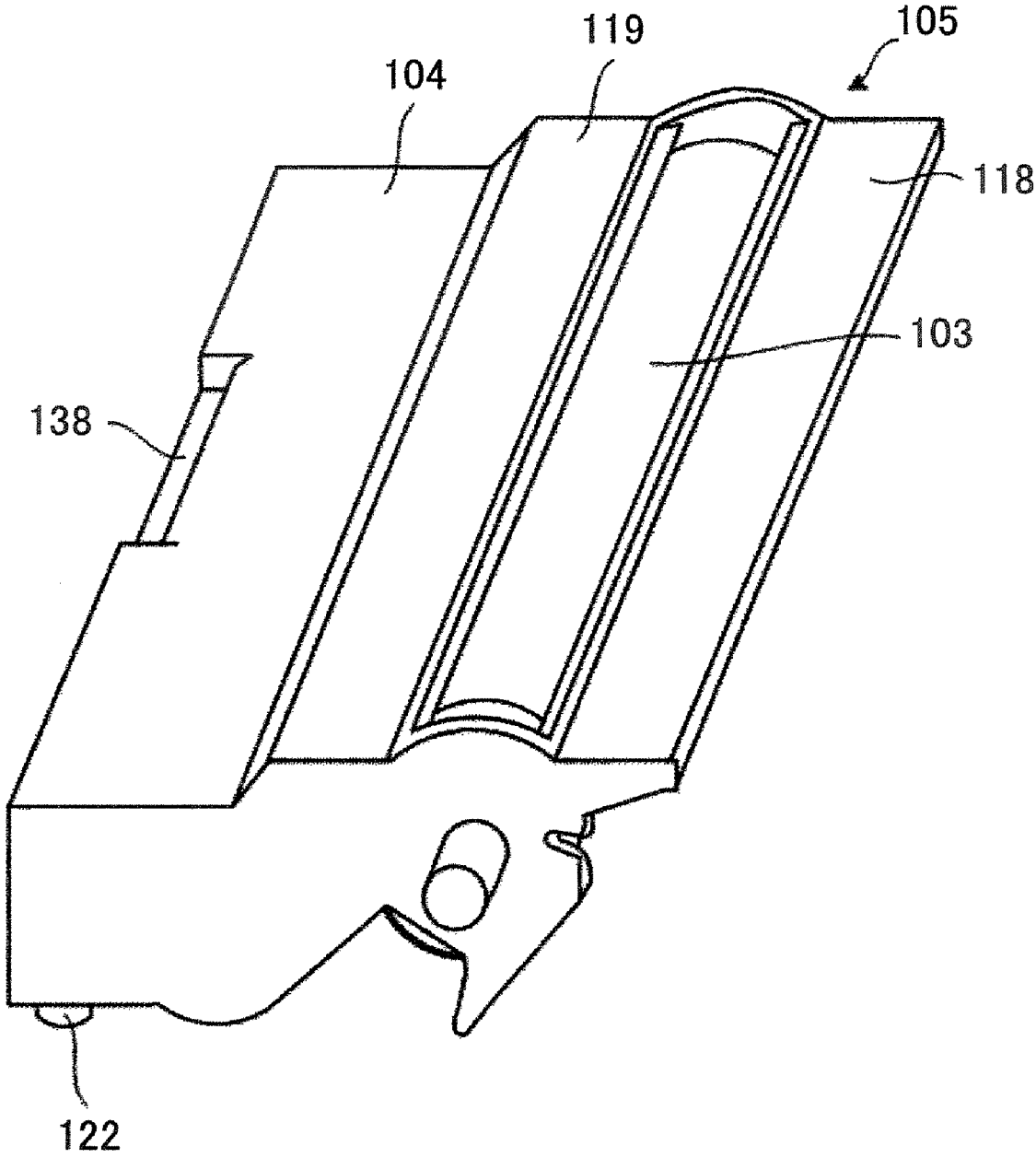
FIG. 3 is a schematic perspective view showing an appearance of a photoconductor toner unit detached from an image station.

FIG. 3 is a schematic perspective view showing an appearance of a photoconductor toner unit detached from the image station. Driving transfer systems of the photoconductor and the toner storage unit and other accompanying parts are omitted for ease of understanding. As shown in FIG. 3, in order to expose a minimum necessary area of the photoconductor 103, other area is covered with the toner storage unit 104 and a formed face/shape of the holder unit 118 so as to protect the photoconductor 103. The shape of the photoconductor toner unit 105 is formed as shown in FIG. 3 since the replacement time of the photoconductor toner unit 105 is determined in accordance with the capacity of the toner storage unit 104. Thus, that it is necessary to have a large capacity so that a large amount of toner is held. In view of this, the shape of the toner storage unit 104 is extended in substantially parallel with a rotation axis of the photoconductor 103 in a depth direction as shown in FIG. 3, having at least a length of the photoconductor 103 in a longitudinal direction. The toner storage unit 104 is held in a height direction by the paper conveying path and the imaging unit such as the development device 108 and the like, so that an allowable space is calculated from shapes and positions of those elements so as to obtain a maximum space. The toner storage unit 104 in a width direction has at least a width of the development device 108 and further has an additional length depending on an available space of the image forming apparatus. By forming the shape of the toner storage unit 104 in this manner, stability of the photoconductor toner unit 105 is improved when only the photoconductor toner unit 105 is placed on a floor and the like. In addition, a concave portion partially formed at a substantially central portion of the toner storage unit 104 in the longitudinal direction in FIG. 3 is a grip portion 138 for gripping the photoconductor toner unit 105 when the user tries to detach the photoconductor toner unit 105.

The image station 200 including the photoconductor toner unit 105 is formed to have a shape as shown in FIG. 2 so that the photoconductor toner unit 105 is formed to have a shape as shown in FIG. 2 taking into consideration a balance of the shape and size between the photoconductor toner unit 105 and the development device 108 and the cleaning unit 110, and that an entire shape of the image station 200 is formed to have substantially a rectangular parallelepiped shape with reduced concavity and convexity. By forming the image station 200 to have substantially a rectangular parallelepiped shape, it is possible to reduce or eliminate an unused space in the image forming apparatus 100 when the image station 200 is inserted and it is possible to facilitate handling of the image station 200 and improve portability and capability of loading at a factory and the like.

Next, the cleaning unit is described. As shown in FIG. 2, the cleaning unit 110 is formed by integrating, using a cleaning container 135, the cleaning device 130 including a cleaning blade 131 as a cleaning unit removing dust and toner residual on a surface of the photoconductor 103 and a sealing roller 132 for preventing scattering of toner upon cleaning with a screw 134 for conveying the removed dust and toner residual on the surface of the photoconductor 103 to a waste toner cassette (not shown in the drawings). The sealing roller 132 and the screw 134 are rotatably supported by the cleaning container 135 and connected to the cleaning device 130 by a gear train (not shown in the drawings). In addition, the cleaning unit 110 is positioned such that a relative position relative to the photoconductor toner unit 105 and the photoconductor 103 is determined with high accuracy by storing and fixing the cleaning unit 110 in the unit case 123 rotatable and integrated with the side plate 124. The cleaning unit 110 is also detachable from the unit case 123 so that it is possible to solely replace the cleaning unit 110. In other words, the cleaning unit 110 is positioned and fixed on the side plate 124 in the same manner as in the photoconductor toner unit 105 and the cleaning unit 110 is solely detachable and capable of being close to or spaced from the photoconductor toner unit 105.

The charging roller 125 is a charging unit uniformly charging the surface of the photoconductor 103. The charging roller 125 is pivotally supported by the unit case 123 and connected to the photoconductor 103 by the gear train. Further, the charging roller 125 is positioned such that a relative position relative to the photoconductor toner unit 105 and the photoconductor 103 is determined with high accuracy. The charging roller 125 is detachable from the unit case 123 for solo replacement. In other words, the charging roller 125 is positioned on the side plate 124 in the same manner as in the photoconductor toner unit 105 and the cleaning unit 110, configured to be solely detachable based on life and replacement time, and capable of being close to or spaced from the photoconductor toner unit 105.

Image forming operations of the image forming apparatus according to the present embodiment are described with reference to FIGS. 1 and 2. The charging roller 125 uniformly charges the surface of the photoconductor 103 rotating in the clockwise direction upon forming an image. The charged surface of the photoconductor 103 is scanned by the writing unit 106 and an electrostatic latent image is formed. The formed electrostatic latent image is moved to the development device 108 in accordance with the rotation of the photoconductor 103 and the electrostatic latent image is developed to be a visible image by the development roller 127 and a toner image is formed on the photoconductor 103. In a case of two component development, in the development device 108, carriers are positively charged and toner is negatively charged by the conveying screw 128 and the paddle roller 129, the carriers and toner attracted on the development roller 127 by a magnet of the development roller 127 form a magnetic brush at a portion facing the photoconductor 103, and the toner on the magnetic brush is attached only to the electrostatic latent image in accordance with a developing bias and a toner image is formed, the electrostatic latent image being formed on the photoconductor 103. Then, the transfer paper S is conveyed from the paper feed cassette 112 or the pair of rollers 114 for manual feeding at a time when the toner image on the photoconductor 103 reaches a transfer position, and the toner on the photoconductor 103 is transferred by the transfer roller 111. The transfer paper S on which the toner image is transferred is sent to the fixing device 109, where the toner image is fixed using pressure and heat, and then the transfer paper S is ejected to the paper ejection unit 117. On the other hand, electricity of the photoconductor 103 after the transfer is removed by a quenching lamp 136, toner residual on the photoconductor 103 is scraped off by the cleaning blade 131 of the cleaning device 130 in the cleaning unit 110, and the toner scraped off is conveyed to the waste toner cassette (not shown in the drawings). While the cleaning blade 131 performs cleaning on the photoconductor 103, the sealing roller 132 prevents scattering of toner generated at an abutment portion with the photoconductor 103.

Figure 4:
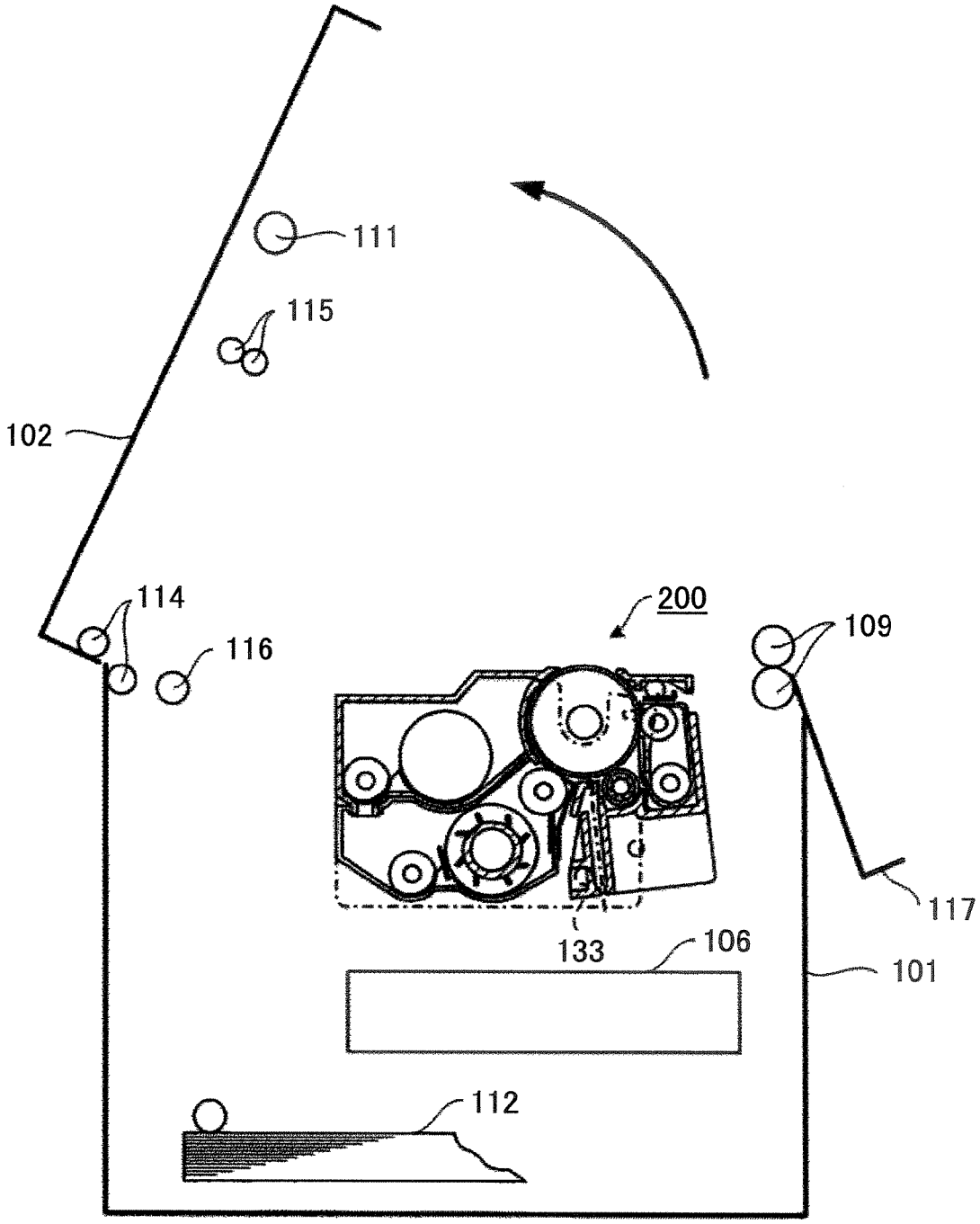
FIG. 4 is a schematic cross-sectional view showing an operation procedure for detaching each unit from an image station in an image forming apparatus of the present invention.
Figure 5:
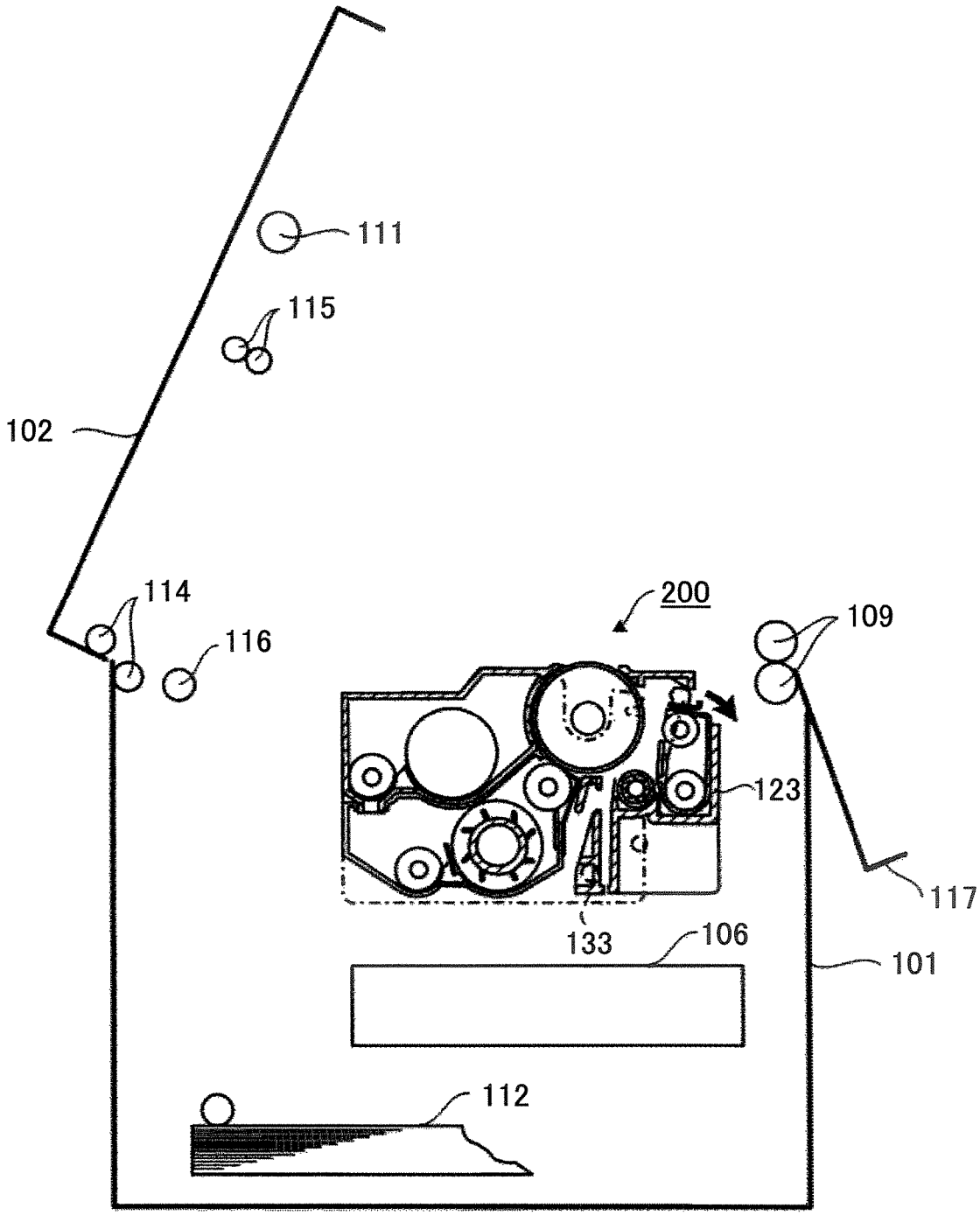
FIG. 5 is a schematic cross-sectional view showing an operation procedure for detaching each unit from an image station in an image forming apparatus of the present invention.
Figure 6:
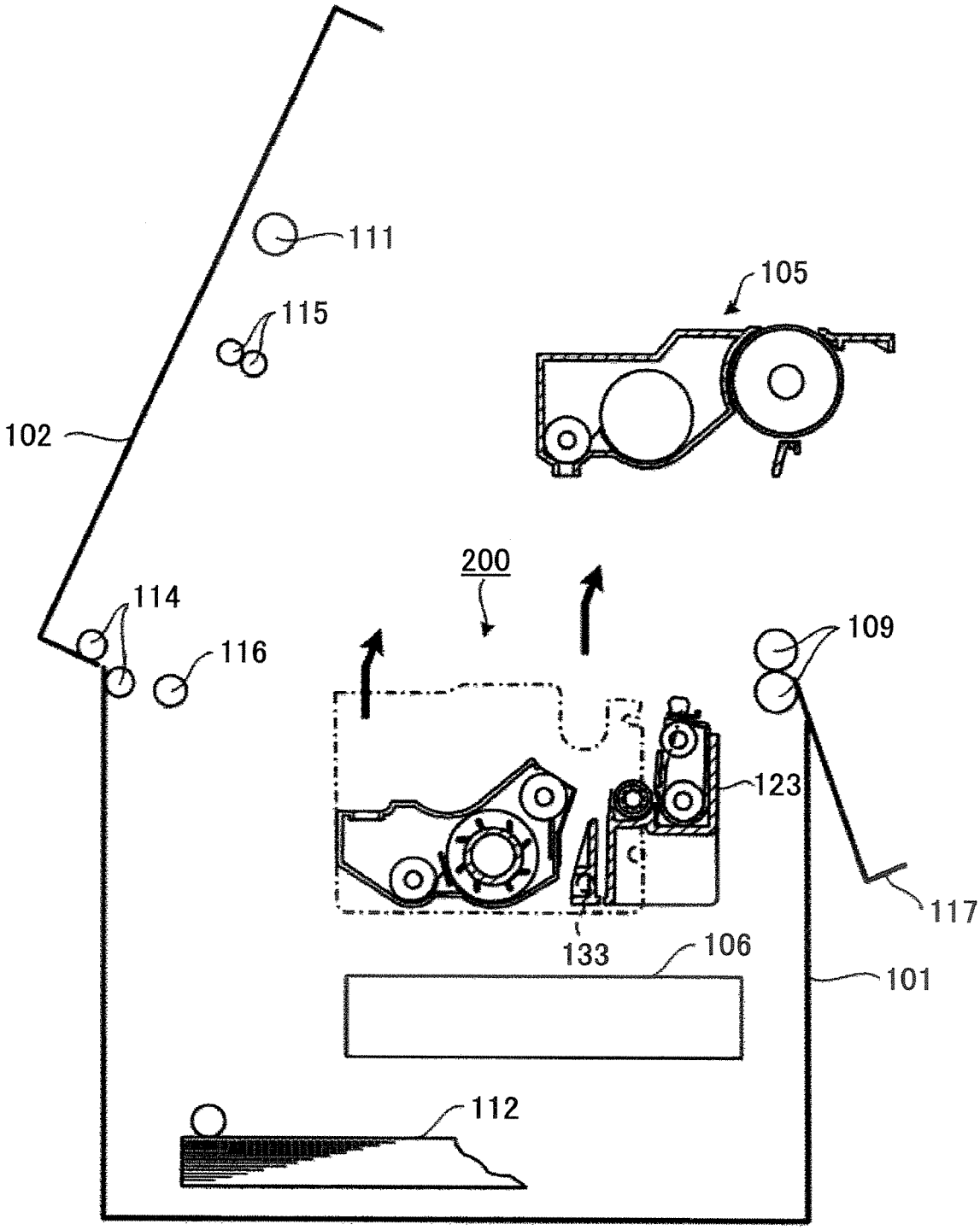
FIG. 6 is a schematic cross-sectional view showing an operation procedure for detaching each unit from an image station in an image forming apparatus of the present invention.
Figure 7:
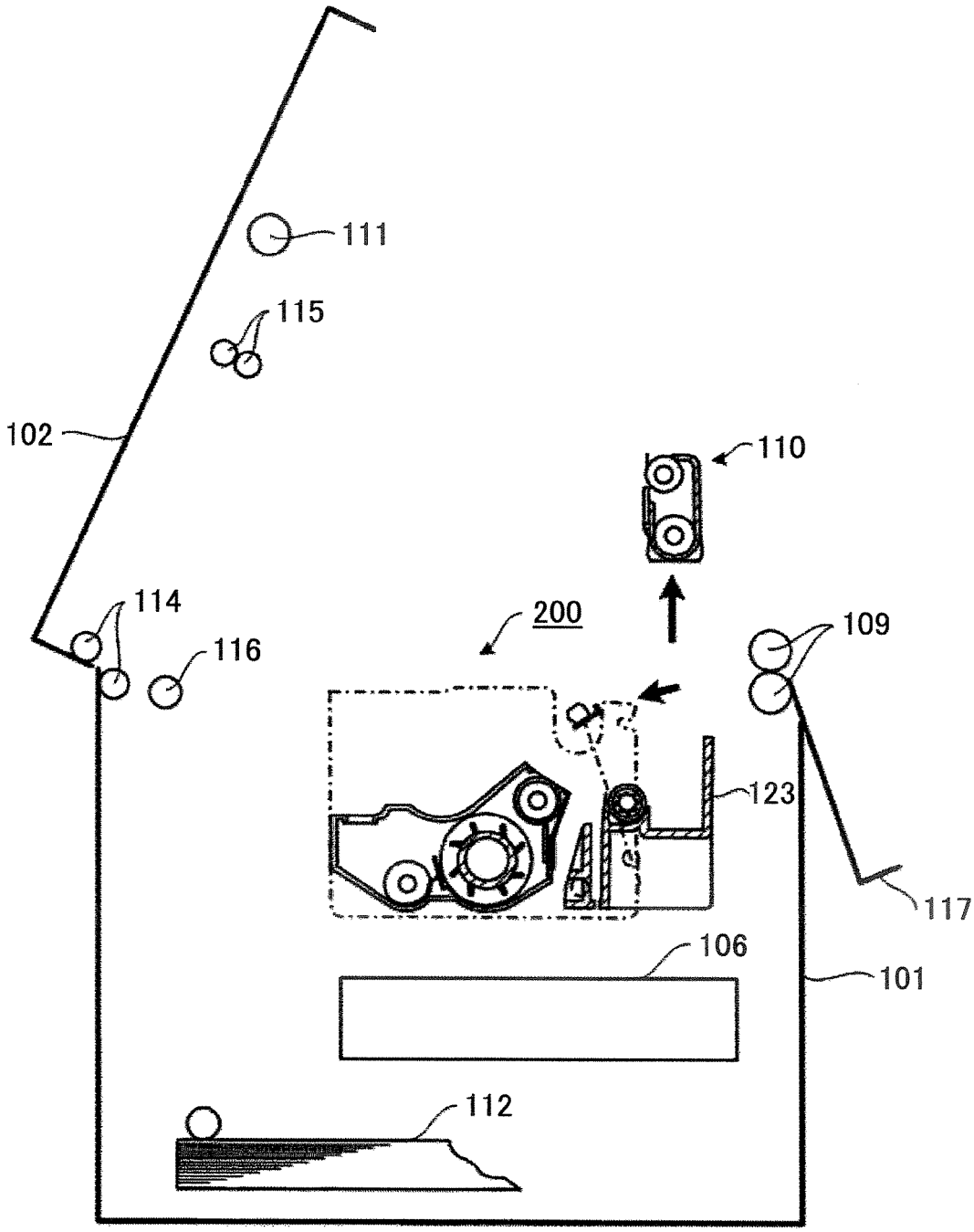
FIG. 7 is a schematic cross-sectional view showing an operation procedure for detaching each unit from an image station in an image forming apparatus of the present invention.
Figure 8:
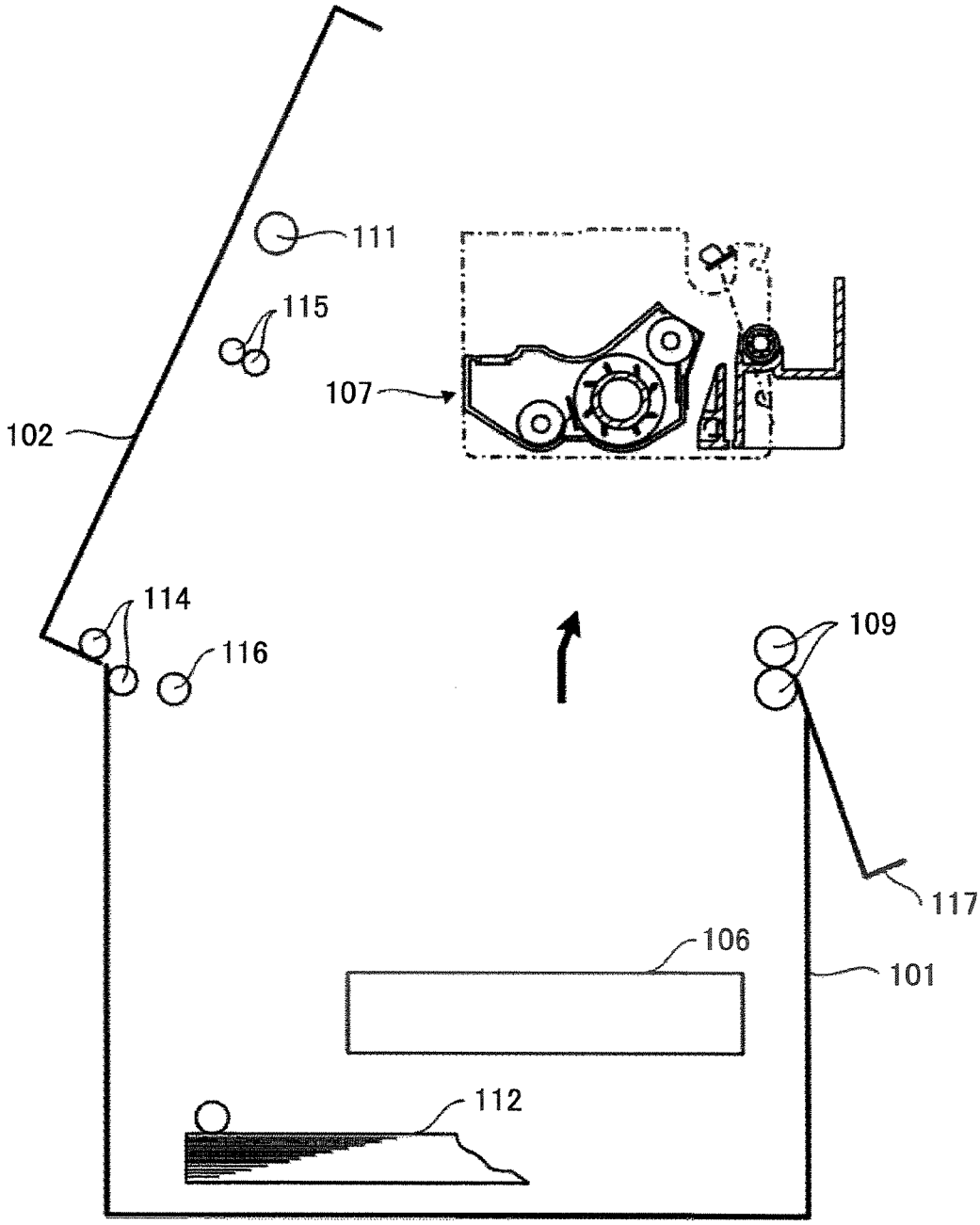
FIG. 8 is a schematic cross-sectional view showing an operation procedure for detaching each unit from an image station in an image forming apparatus of the present invention.

FIGS. 4 to 8 are schematic cross-sectional views showing an operation procedure for detaching each unit from the image station in the image forming apparatus of the present invention. From FIG. 1 where image forming is possible, the upper enclosure 102 including a portion of the paper conveying path, the transfer roller, and the like is rotated on a fulcrum (not shown in the drawings) and the upper enclosure 102 is open upward in a door-like manner, so that an upper portion of the image station 200 is open as shown in FIG. 4. An opening angle of the upper enclosure 102 in this case is determined such that opening allows operations for detaching each unit without trouble. Next, as shown in FIG. 5, a lock of a locking unit (not shown in the drawings) fixing the photoconductor toner unit 105 of the image station 200 and the unit case 123 of the photoconductor toner unit 105 is released and the unit case 123 is rotated in the clockwise direction on the fulcrum 133, so that the cleaning device 130 and the charging roller 125 are spaced from the photoconductor toner unit 105 and the photoconductor 103. As shown in FIG. 6, the photoconductor toner unit 105 is raised upward, the photoconductor 103 and discharge outlet 122 of the toner storage unit 104 are pulled off from the development unit 107 (side plate 124), so that they are detached from the image forming apparatus 100. Next, as shown in FIG. 7, a holder 137 of the quenching lamp 136, which is a portion of a locking unit fixing the cleaning unit 110, is rotated in the counterclockwise direction and a lock of the cleaning unit 110 is released, so that the cleaning unit 110 is detached toward an upper open space from the development unit 107 (side plate 124), namely, the image forming apparatus 100. The development device 108 generally has a long life and is not replaced until an unexpected situation such as failure is generated. However, when the development device 108 is replaced, as shown in FIG. 8, a lock of a locking unit fixing the development unit 107 on the lower enclosure 101 is released and mechanisms such as a driving unit, a waste toner conveying unit, and the like are separated, so that the development unit 107 is detached from the image forming apparatus 100.

In order to form an image from FIG. 8, the operation procedure shown in FIGS. 4 to 8 may be reversely performed. Although the detachment from the image forming apparatus 100 is possible by sequentially detaching each unit as mentioned above, it is also possible to detach an entire portion of the image station 200 in which each unit is embedded therein.

Figure 9:
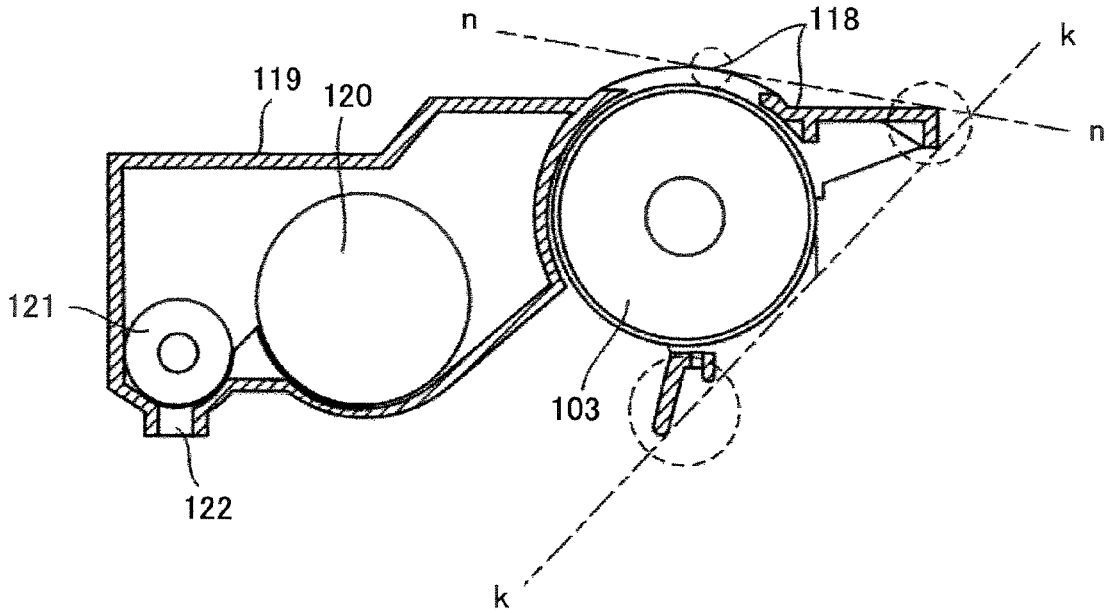
FIG. 9 is a schematic cross-sectional view showing a structure of an accompanying portion of a photoconductor toner unit according to an embodiment of the present invention.

As mentioned above, the photoconductor toner unit 105 (photoconductor 103) of the present embodiment is required to be close to or in contact with the imaging units such as the development roller 127, the cleaning device 130, the charging roller 125, and the like upon image forming, so that the surface of the photoconductor toner unit 105 facing those elements is exposed. Although other portion is covered with the housing 119, when the detached photoconductor toner unit 105 is placed outside the image forming apparatus 100, the photoconductor 103 may experience negative effects if the exposed portion is brought into contact with something. In view of this, the photoconductor toner unit 105 according to the present embodiment has a portion with a shape protruding toward the outside relative to the surface of the photoconductor 103 as shown in FIGS. 3 and 9 in the holder unit 118 of the housing 119 which is an accompanying member of the photoconductor 103. In accordance with this, even when the photoconductor toner unit 105 is brought into contact with something during a replacement operation, it is possible to protect the photoconductor 103 using the protruding portion. Moreover, by disposing the photoconductor 103 such that line k-k or line n-n connecting each end of severally formed protruding portions (portions surrounded with broken lines in FIG. 9) are positioned outside relative to the surface of the photoconductor 103, even when the photoconductor toner unit 105 is placed with line k-k or line n-n as a bottom thereof on a floor, for example, the exposed portion is not in contact with the floor, and it is possible to protect the photoconductor 103. Thus, the users are capable of replacing the photoconductor toner unit 105 without paying attention and improve efficiency of operation.

Figure 10:
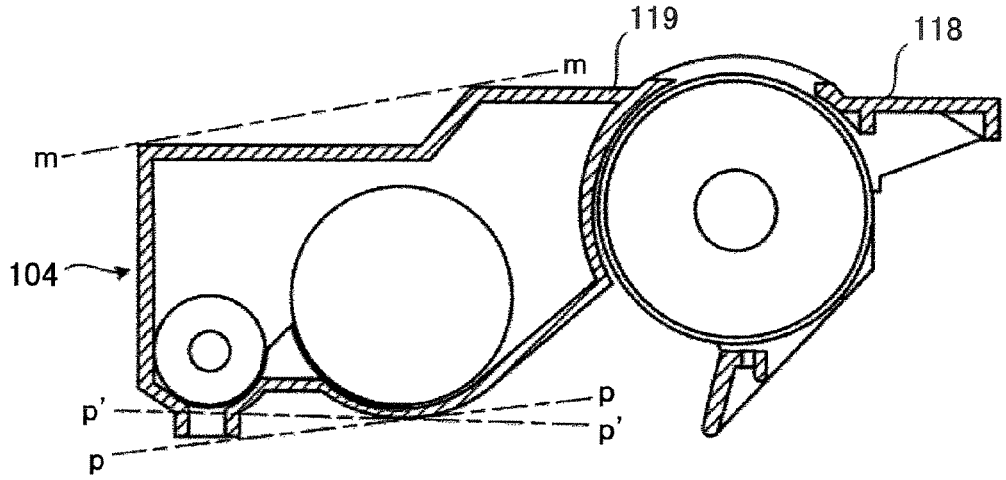
FIG. 10 is a schematic cross-sectional view showing a structure of an accompanying portion of a photoconductor toner unit according to an embodiment of the present invention.

The photoconductor toner unit 105 according to the present embodiment is configured to protect the photoconductor 103 by also using a surface shape of the toner storage unit 104 in the same manner as in the holder unit 118. As shown in FIGS. 3 and 10, a shape of the toner storage unit 104 of the housing 119 in the photoconductor toner unit 105 is formed such that the toner storage unit 104 has a portion positioned outside relative to the surface of the photoconductor 103. In accordance with this, the photoconductor 103 is protected. Further the portion positioned outside is formed on several locations, line p-p connecting each end, line p'-p' on the back side of the figure, and line m-m are positioned outside relative to the surface of the photoconductor 103, so that the same effect as in the holder unit 118 is obtained.

Figure 11:
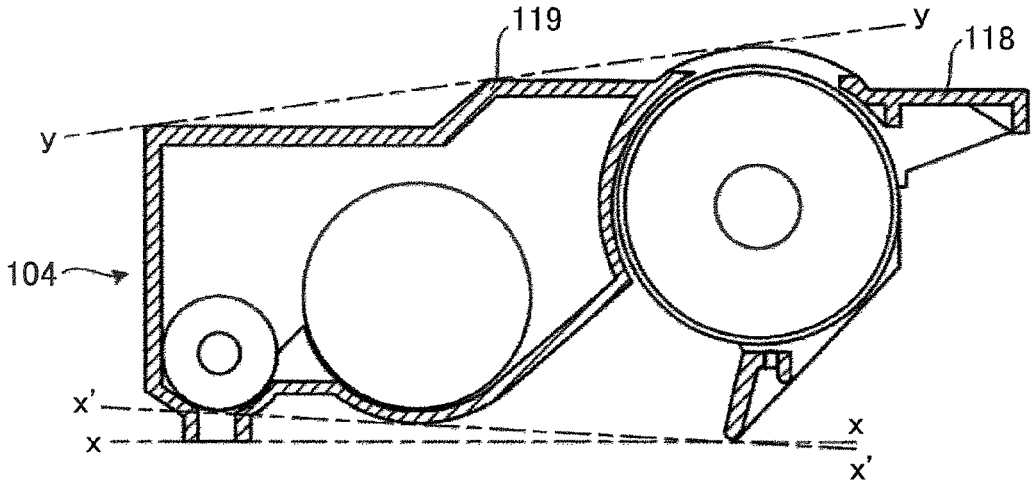
FIG. 11 is a schematic cross-sectional view showing a structure of an accompanying portion of a photoconductor toner unit according to an embodiment of the present invention.

Moreover, the photoconductor toner unit 105 according to the present embodiment is configured to protect the photoconductor 103 by using both surface shapes of the above-mentioned holder unit 118 and the toner storage unit 104. As shown in FIGS. 3 and 11, shapes or portions positioned outside relative to the surface of the photoconductor 103 are formed on the holder unit 118 and the toner storage unit 104 in the photoconductor toner unit 105. When the photoconductor toner unit 105 is placed with line y-y connecting each end, line x-x, and line x'-x' on the back side of the figure as a bottom thereof on the floor, the exposed portion is not in contact with the floor.

Figure 12:
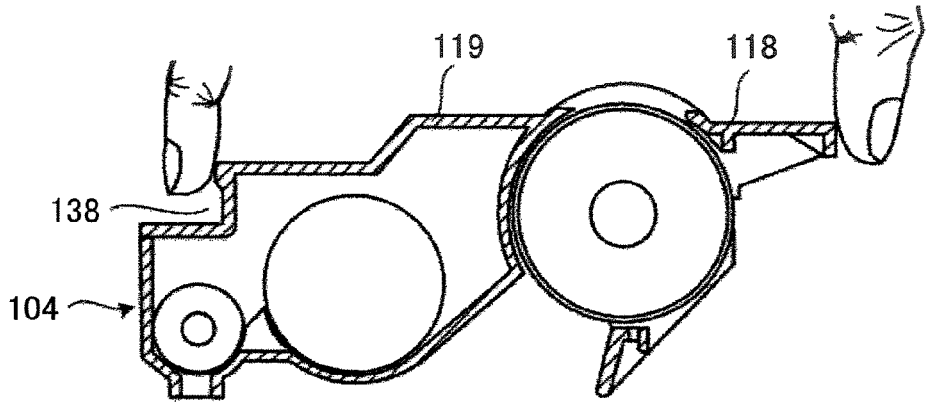
FIG. 12 is a schematic cross-sectional view showing a photoconductor toner unit according to an embodiment of the present invention being held.

In the photoconductor toner unit 105 according to the present embodiment, the photoconductor 103 and the transfer paper S must be brought into contact upon image forming as shown in FIG. 1, so that a portion facing the transfer roller 111 is exposed and a face of the holder unit 118 is positioned inside relative to the exposed portion. In other words, at this portion, the photoconductor 103 protrudes relative to the holder unit 118 as much as at least a length of the photoconductor 103 in the longitudinal direction. In order to avoid contact with the floor and the like when the photoconductor toner unit 105 is detached, upper portions of both sides of the holder unit 118 forming line n-n and line y-y are positioned outside relative to the photoconductor 103, the holder unit 118 pivotally supporting the photoconductor 103. However, the exposed portion may experience unexpected contact while the photoconductor toner unit 105 is being detached from the image forming apparatus 100. In order to prevent such unexpected contact, the photoconductor toner unit 105 according to the present embodiment is configured as shown in FIGS. 3 and 12 such that the concave grip portion 138 formed on an upper portion of the toner storage unit 104 and an end of the holder unit 118 are gripped and raised by one hand upon detachment and the exposed portion is covered with the palm of the hand of the user. In accordance with this, the hand of the user is used for protection and it is possible to prevent the exposed portion from experiencing unexpected contact.

Further, when the photoconductor toner unit 105 is detached from the image forming apparatus 100, the photoconductor toner unit 105 in the image forming apparatus 100 is gripped as shown in FIG. 12, the photoconductor toner unit 105 is raised upward and detached as shown in FIG. 6, and the photoconductor toner unit 105 is placed with line x-x and line x'-x' shown in FIG. 11 as a bottom thereof on the floor while maintaining this status or position, so that the exposed portion is not in contact with the floor. In this manner, according to the photoconductor toner unit 105 of the present embodiment, in the image forming apparatus including a transfer unit above the photoconductor 103, a user grip portion (grip portion 138 in FIG. 3) for detaching the photoconductor toner unit 105 is disposed on the upper portion of the photoconductor toner unit 105, so that it is possible to detach upward while maintaining a status or position when installed on the image forming apparatus 100 and place the photoconductor toner unit 105 on the floor. Thus, the photoconductor toner unit 105 is convenient in terms of replacement and it is possible to protect the photoconductor 103.

As mentioned above, according to the image carrier unit of the present embodiment, it is possible to solely replace the photoconductor, so that the burden for the users, manufacturers, and the environment is reduced. Further, in order to improve usability, the photoconductor and the toner storage unit storing toner to be supplied to the development device are integrated, so that the user is capable of readily replacing the photoconductor and the toner storage unit as a photoconductor toner unit.

Next, according to an image carrier unit of another embodiment, a relationship of relative position is high accurate when the photoconductor toner unit and peripheral imaging units for the photoconductor such as a development device relating to the photoconductor toner unit are integrated and it is possible to readily detach each unit upon replacement or the like.

Figure 13:
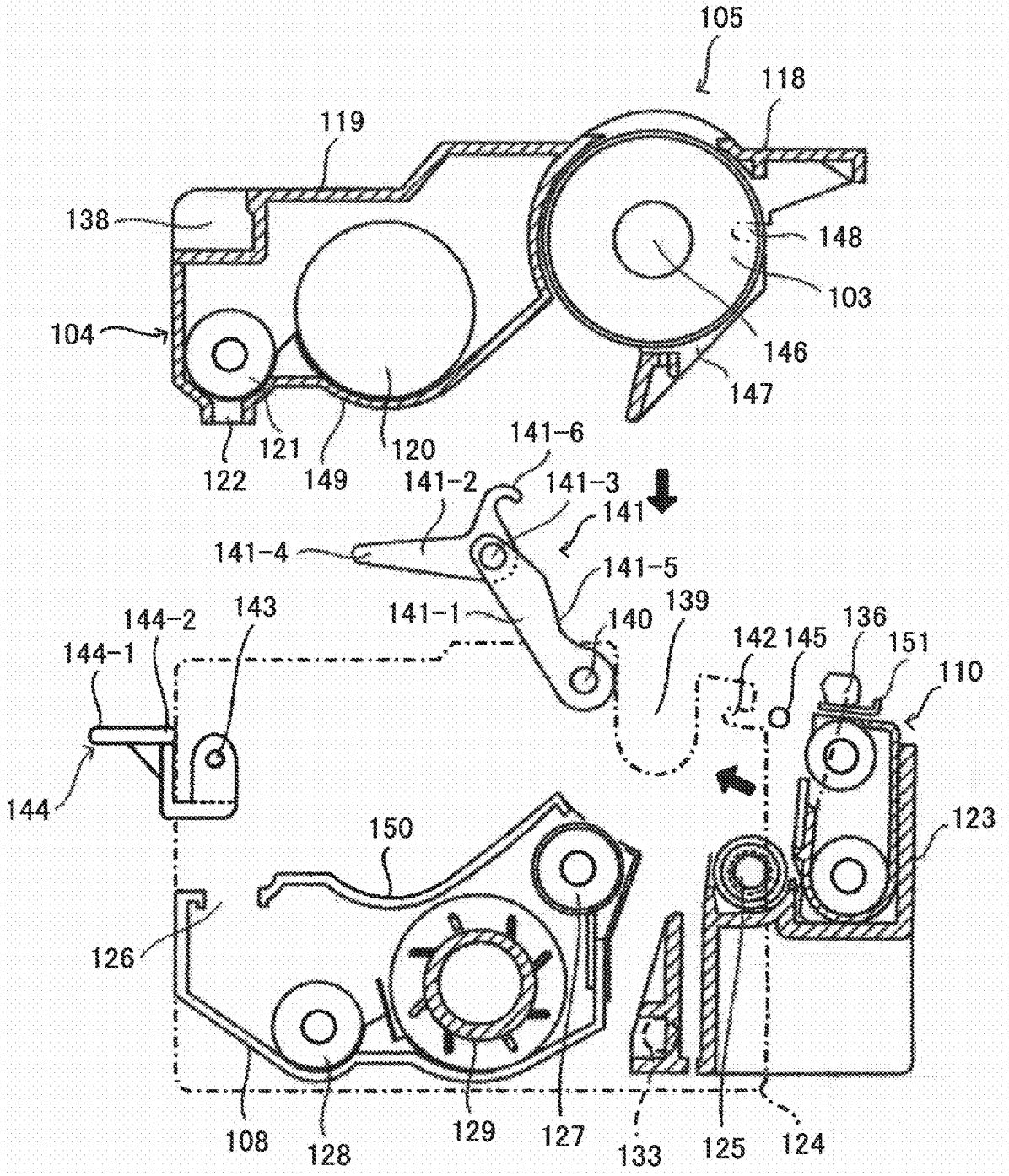
FIG. 13 is a schematic cross-sectional view showing a structure of an image carrier unit according to another embodiment of the present invention.
Figure 14:
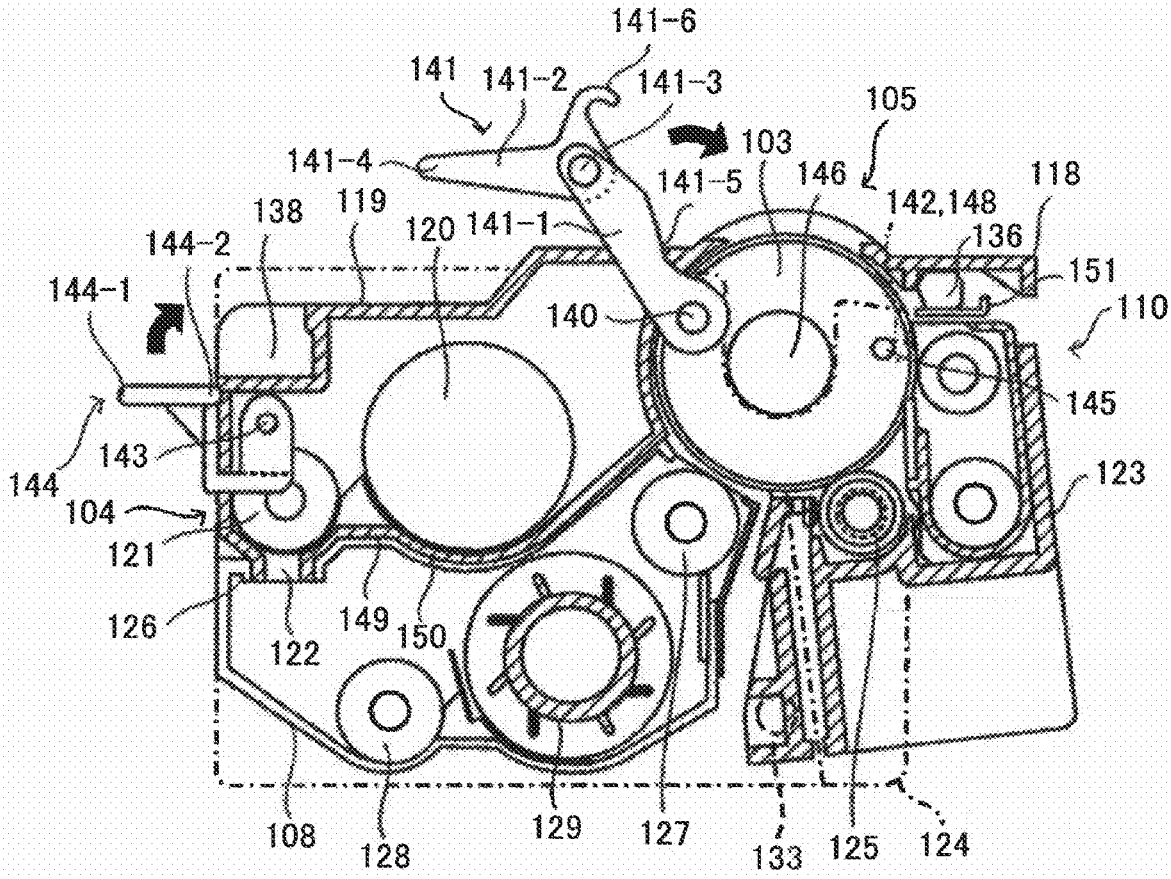
FIG. 14 is a schematic cross-sectional view showing a structure of an image carrier unit according to another embodiment of the present invention.
Figure 15:
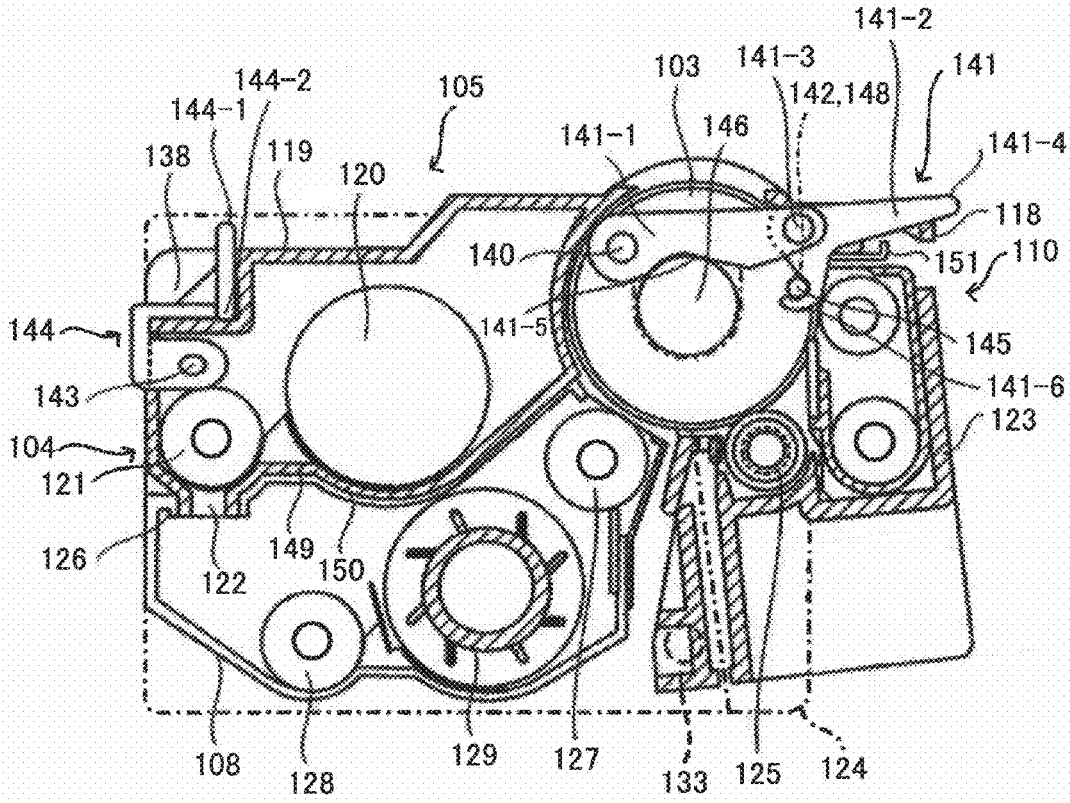
FIG. 15 is a schematic cross-sectional view showing a structure of an image carrier unit according to another embodiment of the present invention.

FIGS. 13 to 15 are schematic cross-sectional views showing a structure of an image carrier unit according to another embodiment of the present invention. In the figures, main elements are described for ease of understanding of description and the figures and driving units or portions unnecessary for description are omitted. In FIGS. 13 to 15, as mentioned above, the partially concave grip portion 138 is disposed on a substantially central portion of the housing 119 of the toner storage unit 104 in the photoconductor toner unit 105 in the longitudinal direction. The grip portion 138 is a grip portion for gripping the photoconductor toner unit 105 when the user tries to detach the photoconductor toner unit 105 and is also a reception portion for a mechanism for locking the photoconductor toner unit 105 described later. The lock mechanism is configured to prevent the user from gripping the grip portion 138 unless a lock of the lock mechanism is released and the lock mechanism is detached, so that an erroneous procedure of operation by the user is prevented. Further, in an upper right end of the side plate 124 of the toner storage unit 104, a U-shaped groove portion 139 is disposed so as to form a positioning and fixing portion for the photoconductor toner unit 105. A shaft 140 is securely installed on the left side of the U-shaped groove portion 139, the shaft 140 protruding in the front direction of the figure, where a two-stage motion lever 141 for positioning and fixing the photoconductor toner unit 105 and the cleaning unit 110 is rotatably and pivotally supported. The lever 141 includes a lever unit 141-1, a lever unit 141-2, and a lever shaft 141-3 for rotatably connecting the lever unit 141-1 and the lever unit 141-2. The lever 141 is rotatably and pivotally supported by the shaft 140 and constitutes a two-stage link mechanism. Also, a slit groove 142 is formed on a position facing the lever 141 and having the U-shaped groove portion 139 therebetween, the slit groove 142 having a radius of curvature using the fulcrum 133 as a center. Further, a shaft 143 is securely installed on the side plate 124, the shaft protruding in the front direction of the figure, where a lever 144 for positioning and fixing the photoconductor toner unit 105 is rotatably and pivotally supported. Biasing members (not shown in the drawings) such as springs are attached to the lever 141 and the lever 144.

A top face of the unit case 123 is open so that the cleaning unit 110 is detachable from above and the unit case 123 is rotatable on the fulcrum 133 so as to face the development device 108. Further, a shaft 145 is securely installed on an upper portion of a side face (not shown in the drawings) of the unit case 123, the shaft 145 protruding in the front direction of the figure. The shaft 145 is in a fitting relationship with the slit groove 142 in a direction of the radius of curvature and functions as a stopper of the unit case 123 upon rotation on the fulcrum 133 in the counterclockwise direction. In addition, a stop position, namely, a position where the shaft 145 is brought into contact with a left end of the slit groove 142 is used as a setting position for a cassette case, namely, the cleaning unit 110, the charging roller 125, and the quenching lamp 136 upon image forming operations.

In the present embodiment, an outside diameter of a bearing 146 of the photoconductor toner unit 105 is set such that the outside diameter is in a fitting relationship with the U-shaped groove portion 139 formed on the side plate 124 of the development device 108. By fitting the bearing 146 in the U-shaped groove portion 139 until an end while both sides of the U-shaped groove portion 139 are used as a guide, a base position of the photoconductor toner unit 105 in the development unit 107 is determined. On a side face of the holder unit 147 of the photoconductor toner unit 105, a slit groove 148 is formed with the same shape and the same curvature as in the slit groove 142 formed on the side plate 124 of the development unit 107. When the photoconductor toner unit 105 is installed on the development unit 107, the slit groove 142 is placed on the slit groove 148 and the shaft 145 is moved in and out of both slit grooves in accordance with rotation of the unit case 123. A structure for positioning the photoconductor toner unit 105 and the cleaning unit 110 relative to the development unit 107 is disposed on the front side of the figure and also on the back side of the figure. Moreover, when the photoconductor toner unit 105 is installed on the development unit 107 so as to determine a position of the toner storage unit 104 of the photoconductor toner unit 105, a bottom 149 of the toner storage unit 104 is brought into abutment with and a top face 150 of the development device 108.

When the positioning and fixing operations of the cleaning unit 110 and the quenching lamp 136 relative to the unit case 123 are completed as mentioned above, the photoconductor toner unit 105 is installed. The photoconductor toner unit 105 is installed on the development unit 107 from above the development unit 107 as shown in FIG. 13. However, an approaching direction and a method for the development unit 107 immediately before an actual installation are different in each image forming apparatus, so that such a direction and a method are not limited to a specific direction such as lateral directions, oblique directions, front direction of the figure, or the like.

Next, a procedure for installing the photoconductor toner unit on the development unit is described. The toner unit may be detached by reversely performing the installation procedure. As shown in FIG. 13, the cleaning unit 110 is inserted into the unit case 123. Thereafter, a holder 151 to which the quenching lamp 136 is attached is rotated on the fulcrum 133, so that the cleaning unit 110 is positioned and fixed on the unit case 123, and then the photoconductor toner unit 105 is installed from above. In other words, the holder 151 is configured to be a lock unit positioning, fixing, and allowing detachment of the cleaning unit 110 relative to the unit case 123. A position where the cleaning unit 110 is fixed is used as a setting position of the quenching lamp 136 in the unit case 123. In addition, the quenching lamp 136 is detachably attached to the holder 151 for unexpected failure and cleaning. Then, the photoconductor toner unit 105 is installed and positioned on the development unit 107. Thereafter, the unit case 123 is rotated on the fulcrum 133 in the counterclockwise direction so that the cleaning unit 110, the charging roller 125, and the quenching lamp 136 face the photoconductor 103. As mentioned above, the outside diameter of the bearing 146 in the photoconductor toner unit 105 corresponds to a diameter of a semicircular portion of the U-shaped groove portion 139 in the development unit 107 and the bearing 146 and the U-shaped groove portion 139 are in a fitting relationship, so that a lateral position (right and left directions in the drawings) and a height position (upward and downward directions in the drawings) of the photoconductor toner unit 105 are determined relative to the development unit 107. In other words, a central point of the photoconductor 103 corresponds to a central point of the U-shaped groove portion 139 of the development unit 107 used as a positional base (base of assembly) of the image station 200, and the position of the photoconductor 103 relative to the development unit 107 is determined. The position of the photoconductor 103 in the longitudinal direction (depth direction in the drawings) is determined in accordance a size relationship such that the photoconductor toner unit 105 is inserted into the development unit 107, the holder unit 147 of the photoconductor toner unit 105 is brought into close contact and with an inner face of the side plate 124 in sliding manner. The above-mentioned positioning structure is disposed not only on the front side of the drawings but also on the back side of the drawings, so that positioning of the photoconductor toner unit 105 relative to the development unit 107 is performed at two ends of the photoconductor 103 in the longitudinal direction in the above-mentioned structure. However, even when the photoconductor 103 is solely positioned and fixed in the photoconductor toner unit 105, the toner storage unit 104 may be rotated on the photoconductor 103 in the downward direction due to its own weight or may be vibrated due to vibration of a driving system, for example. This may generate negative effects on positional accuracy in the photoconductor toner unit 105 and lack of stability. Thus, it is necessary to position the toner storage unit 104 in terms of prevention of rotation and vibration. In view of this, the toner storage unit 104 is fixed such that the bottom 149 of the toner storage unit 104 is brought into abutment with the top face 150 of the development device 108. In accordance with this, positioning of the photoconductor toner unit 105 is performed at three locations in total and it is possible to determine a stable position for the photoconductor toner unit 105 without vibration. In particular, when two locations on the photoconductor 103 and at least one location on the toner storage unit 104 are disposed as in the present embodiment, it is possible to stably position the photoconductor toner unit 105 with high accuracy. In other words, it is possible to stably position the photoconductor 103 and the toner storage unit 104 with high accuracy without vibration. In addition, although locations and the number of locations for positioning are different depending shapes of the photoconductor toner unit or imaging devices, substantially the same effects are expected by using at least three locations.

In the following, an operation for installing the photoconductor toner unit 105 on the development unit 107 upon positioning the photoconductor toner unit 105 is described. First, the bearing 146 of the photoconductor toner unit 105 is slightly inserted into the U-shaped groove portion 139 and a position in the lateral direction (right and left directions in the drawings) is determined. Next, while a status of the photoconductor toner unit 105 as shown in FIG. 13 is maintained, the photoconductor toner unit 105 is slowly moved downward, using the U-shaped groove portion 139 as a guide, until photoconductor toner unit 105 is brought into contact with the U-shaped groove portion 139 and the top face 150 of the development device 108. However, the bearing 146 may be first inserted to an end of the bearing 146 so that the photoconductor toner unit 105 is titled relative to the development unit 107. In other words, the toner storage unit 104 of the toner storage unit 104 may be raised. Then, the toner storage unit 104 of the photoconductor toner unit 105 may be rotated on the central point of the U-shaped groove portion 139 in the downward direction until the toner storage unit 104 is brought into abutment with the top face 150. In this case, the cleaning unit 110, the charging roller 125, and the quenching lamp 136 are always spaced from the photoconductor toner unit 105, so that the photoconductor 103 is not damaged during the operation.

When the positioning of the photoconductor toner unit 105 on the development unit 107 is completed, the unit case 123 is rotated on the fulcrum 133 in the counterclockwise direction until the shaft 145 of the unit case 123 is brought into abutment with both tips of the slit groove 142 of the development unit 107 and the slit groove 148 of the photoconductor toner unit 105 so that the cleaning unit 110, the charging roller 125, and the quenching lamp 136 face the photoconductor 103. In accordance with this, setting positions of the photoconductor toner unit 105, the cleaning unit 110, charging roller 125, and the quenching lamp 136 are determined relative to the development unit 107 upon performing image forming.

Next, as shown in FIG. 14, when a pinch portion 141-4 as one end of the lever unit 141-2 is pinched and the lever 141 is rotated on the shaft 140 in the clockwise direction, rotation of the lever unit 141-1 is stopped when a face 141-5 of the lever unit 141-1 is brought into abutment with an outside diameter portion of the bearing 146 of the photoconductor toner unit 105. Then, when the pinch portion 141-4 is further rotated in the clockwise direction, only the lever unit 141-2 is rotated on the lever shaft 141-3. In accordance with this, as shown in FIG. 15, an engagement portion 141-6 as other end of the lever unit 141-2 is engaged with the shaft 145 of the unit case 123. In accordance with this engagement, the photoconductor toner unit 105 is pressingly fixed on the development unit 107 by the lever unit 141-1 and the unit case 123 is held and fixed on the development unit 107 by the lever unit 141-2.

Next, the toner storage unit 104 of the photoconductor toner unit 105 is fixed. As mentioned above, the lever 144 is rotatably and pivotally supported by the shaft 143 securely installed on the side plate 124 of the development unit 107. When a pinch portion 144-1 as one end of the lever 144 is pinched and the lever 144 is rotated on the shaft 143 in the clockwise direction, as shown in FIG. 15, a convex press portion 144-2 as other end of the lever 144 is brought into abutment with a bottom of the grip portion 138, which is a concave portion of the toner storage unit 104 of the photoconductor toner unit 105, and the convex press portion 144-2 is biased by a biasing member (not shown in the drawings)

such a spring or the like. In accordance with this biasing, the toner storage unit 104 of the photoconductor toner unit 105 is pressingly fixed on the development unit 107.

As a result, the assembling and fixing of the photoconductor toner unit 105, the cleaning unit 110, the charging roller 125, and the quenching lamp 136 on the development unit 107 is completed, so that the image station 200 is completed. A detachment operation is conducted by reversely performing the above-mentioned operation procedure. Although the present embodiment employs the photoconductor 103 as having a drum-like shape, it is possible to construct the photoconductor 103 into a belt-like shape.

The above-mentioned image forming apparatus according to the present invention is constructed by further developing the photoconductor cassette of the aforementioned Patent Document 3 in which the photoconductor is solely detachable and replaceable. In the image forming apparatus of the present invention, the photoconductor and the toner storage unit storing toner for supplying to the development device are integrated as a unit and the unit is replaceable as a photoconductor toner unit. By integrating the photoconductor and toner to be replaceable at the same time, the photoconductor and toner being consumable elements and have a high replacement frequency in comparison with other imaging units, it is possible to reduce the financial burden for the users and the waste of labor for collection by manufacturers, and to eliminate inconvenience or trouble the users experience upon replacement without generating negative effects on the environment.

Next, in another embodiment described in the following, the above-mentioned idea is further advanced, so that the photoconductor is solely replaceable from the photoconductor toner unit which the photoconductor and the toner storage unit are integrated. In other words, the photoconductor is detachably attached to the photoconductor toner unit. In accordance with this, even when the photoconductor toner unit is employed in a small-type image forming apparatus and the like where it is difficult to match the photoconductor life with the toner capacity described above, namely, it is difficult to have substantially the same time for replacement time for the photoconductor and for toner, it is possible to prevent generation of waste and use up toner and the photoconductor until the life thereof is ended. In conventional process cartridges, the development device, the charging device, the cleaning unit and the like are integrated in the photoconductor as a unit, and these consumable elements are replaced at one time. However, machines employing the process cartridge are small-type image forming apparatuses in many cases in terms of space in the apparatus and readiness of replacement operations by users (requiring no service-providing experts). Thus, by employing the following embodiment in the process cartridge, namely, by making the photoconductor detachable from the process cartridge, it is possible to solve conventional problems and trouble of the process cartridge.

Figure 16:
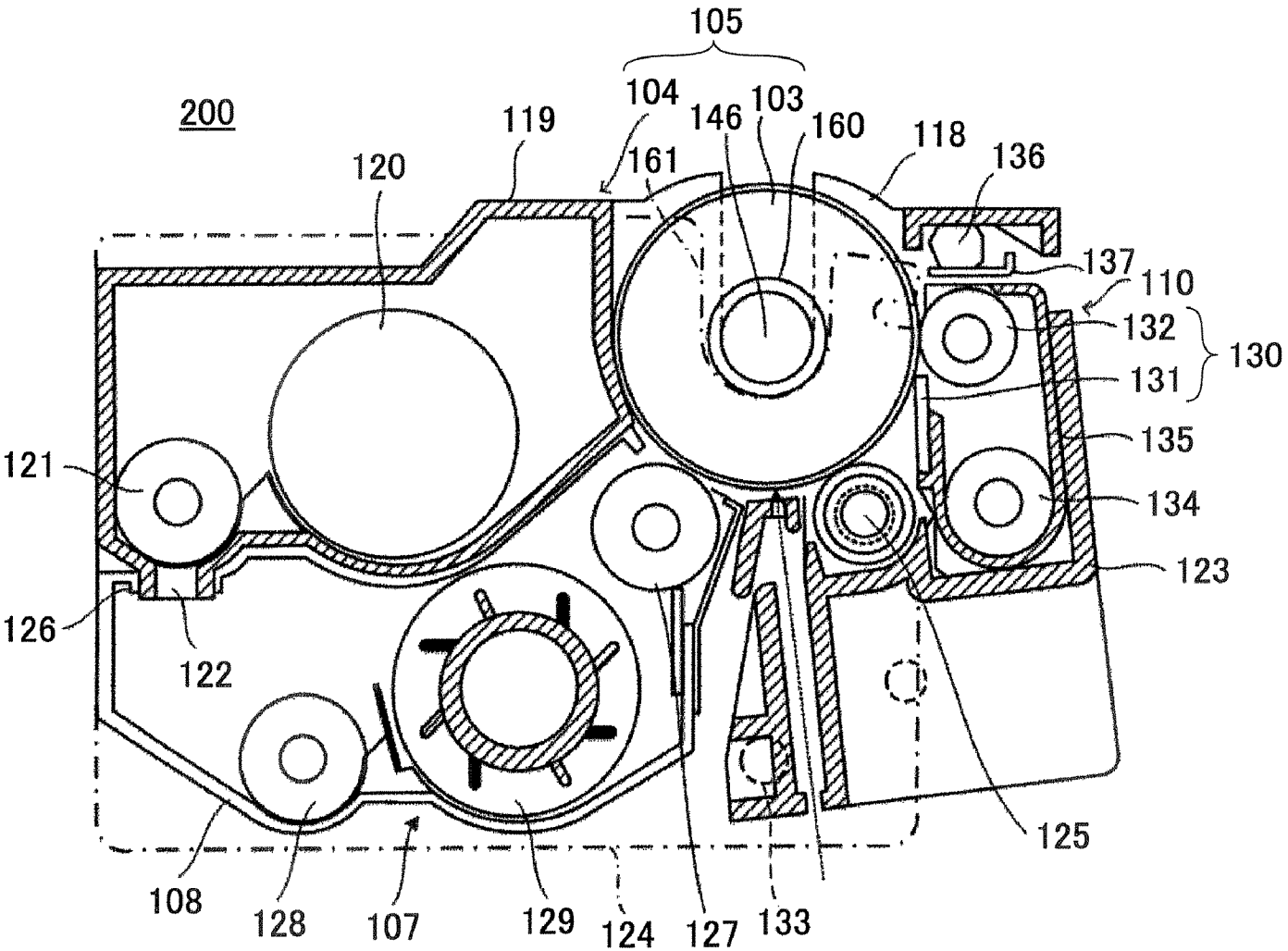
FIG. 16 is a schematic cross-sectional view showing a structure of an image station of an image forming apparatus according to another embodiment of the present invention.
Figure 17:
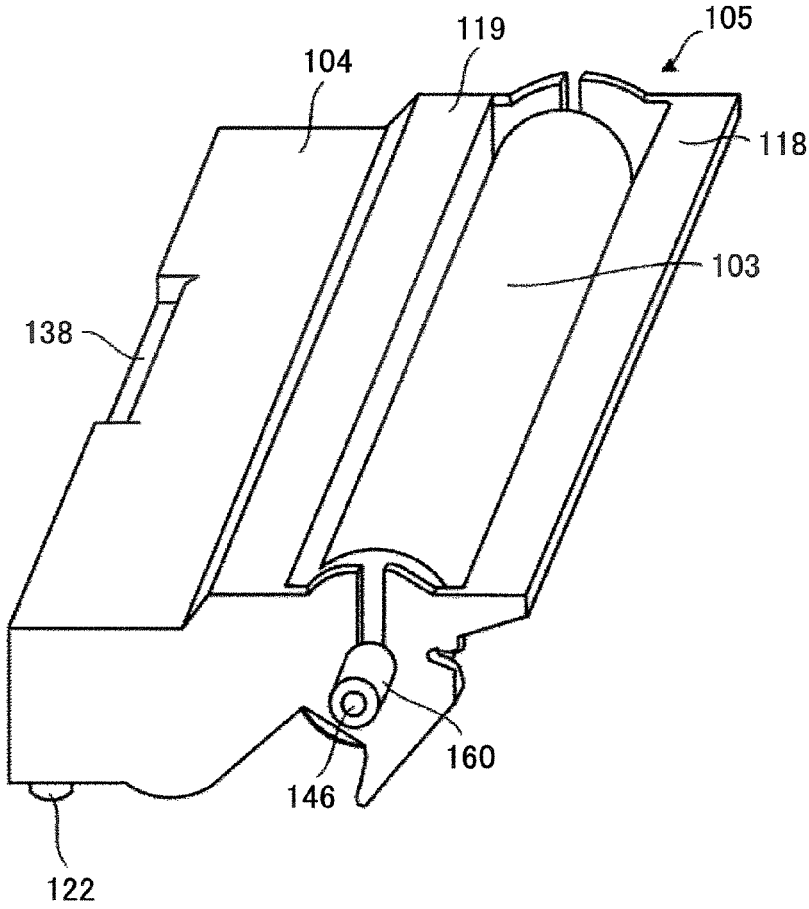
FIG. 17 is a schematic perspective view showing an appearance of a photoconductor toner unit detached from an image station.

FIG. 16 is a schematic cross-sectional view showing a structure of an image station of an image forming apparatus according to another embodiment of the present invention. FIG. 17 is a schematic perspective view showing an appearance of a photoconductor toner unit detached from the image station. In both figures, the same reference numerals as in FIGS. 2 and 3 designate the same constituent elements. The toner unit 105 includes the photoconductor 103 and the housing 119 as an integrally molded supporting member including the holder unit 118 of the photoconductor 103 and the toner storage unit 104. The holder unit 118 protects and rotatably supports the photoconductor 103. In other words, the photoconductor toner unit 105 is a unit in which the photoconductor 103 is rotatably supported in the housing 119 via the bearing 160. Differing from a conventional process cartridge, the photoconductor is not integrated with other imaging units such as the development device, the charging unit, or the like. In the present embodiment, although the housing 119 is configured to be an integrally molded single member, the present embodiment is not limited to this. The housing 119 may be formed using a structure made of combination of plural members. However, an imaging unit other than the photoconductor is not included.

In order to further reduce the burden for the users, manufacturers, and the environment, even when the photoconductor toner unit is employed in a small-type image forming apparatus and the like where it is difficult to match the photoconductor life with the toner capacity, namely, it is difficult to have substantially the same time for replacement time for the photoconductor and for toner, it is necessary to prevent generation of waste and use up toner and the photoconductor until the life thereof is ended. In view of this, in the present embodiment, as shown in FIGS. 16 and 17, the photoconductor 103 is solely replaceable from the writing unit 106 so as to further reducing waste while the basic idea of the photoconductor toner unit is considered. By enabling solo replacement of the photoconductor 103 from the photoconductor toner unit 105, it is possible to replace the housing 119 including the toner storage unit 104 from another point of view. Thus, it is possible to replace the photoconductor or toner at each replacement time and continue to use while the element is usable.

As mentioned above, the replacement time is determined from the relationship between the life of the photoconductor 103 and the capacity of the toner storage unit 104. However, the latest image forming apparatuses have been extremely miniaturized, so that there is no room for increasing the capacity of toner in terms of space. Products currently available are capable of storing toner allowing printing of 1.5 to 2 thousand sheets at most. In view of this, the following three methods are considered in order to eliminate waste in the photoconductor toner unit. In a first method, when toner is required to be replaced but the photoconductor is capable of use, the photoconductor still usable is detached from the photoconductor toner unit in which toner is completely consumed, and the detached photoconductor is installed on a new housing with full of toner. In accordance with this, the photoconductor continues to be used until the life of the photoconductor is ended. In a second method, when the photoconductor is required to be replaced but the toner is capable of use, the photoconductor is detached from the photoconductor toner unit in which toner is not completely consumed, and a new photoconductor is installed on the housing with the remaining toner. In accordance with this, the photoconductor toner unit continues to be used until the toner is completely consumed. In a third method, while the photoconductor and toner is separately replaced at each replacement time, one replacement time happens to coincide with another replacement time sometimes, so that the whole photoconductor toner unit is replaced with a new one.

Figure 18:
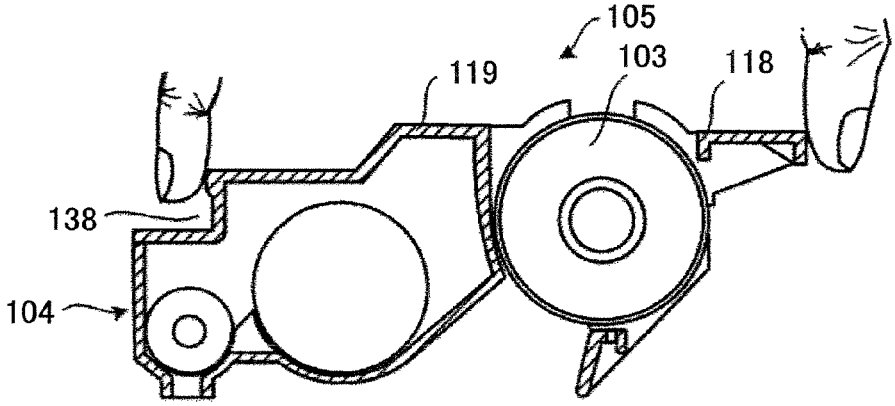
FIG. 18 is a schematic cross-sectional view showing a photoconductor toner unit according to an embodiment of the present invention being held.
Figure 19:
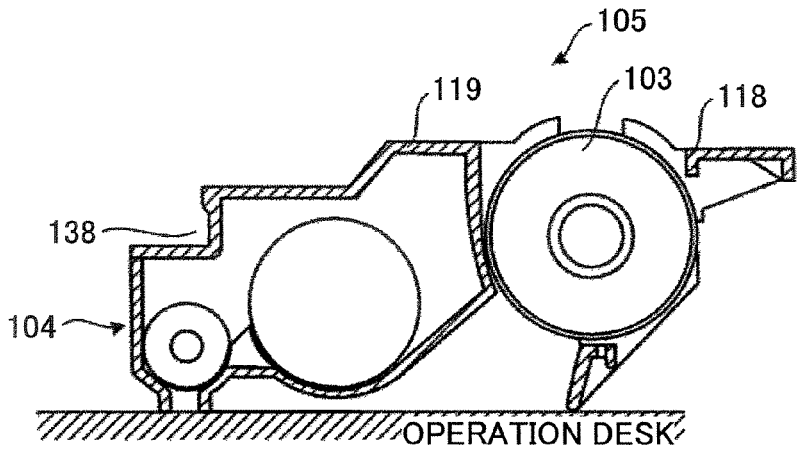
FIG. 19 is a schematic cross-sectional view showing a photoconductor toner unit placed on an operation desk.
Figure 20:
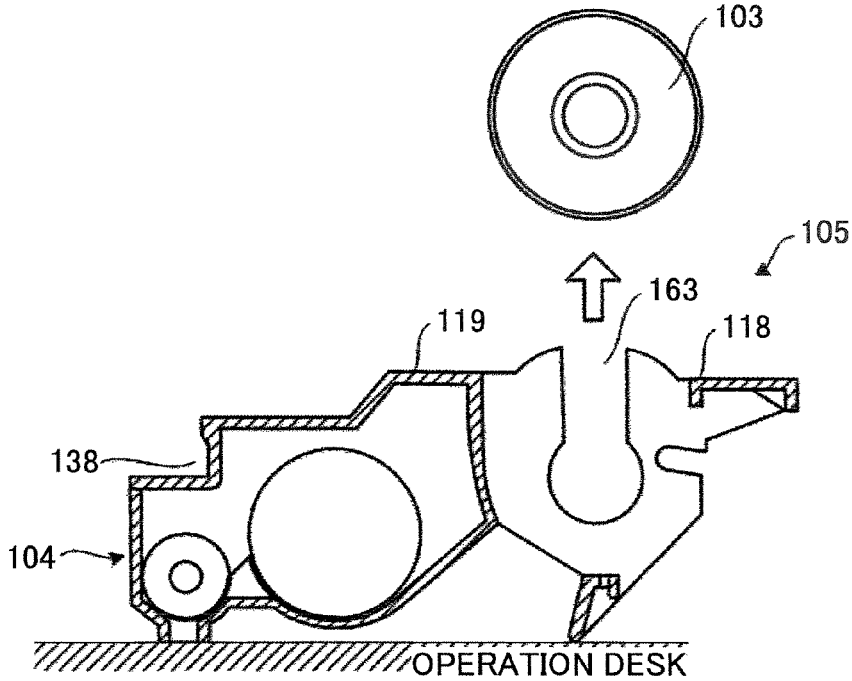
FIG. 20 is a schematic cross-sectional view showing an operation for detaching a photoconductor from a photoconductor toner unit according to an embodiment of the present invention.

Next, a procedure for replacing the photoconductor is described. As shown in FIG. 16, the photoconductor toner unit 105 is positioned and fixed with high accuracy on the side plate 124 integrated with the development device 108 and the photoconductor toner unit 105 is detachable. A lock of a lock unit (not shown in the drawings) of the photoconductor toner unit 105 is released in a status as shown in FIG. 16. As shown in FIG. 18, the grip portion 138 formed on an center of the upper portion of the toner storage unit 104 in the longitudinal direction and a right end of the holder unit 118 are gripped and raised upward along a U-shaped groove portion 161 disposed on the upper portion of the side plate 124 shown in FIG. 16, so that the photoconductor toner unit 105 is detached from the development device 108 of the image station 200. While the photoconductor toner unit 105 is held by the hand of the user, the palm of the hand of the user is used for protecting the exposed portion in the upper portion of the photoconductor toner unit 105. When the photoconductor toner unit 105 is detached from the development device 108 in the image station 200, the photoconductor toner unit 105 is placed on an operation desk as shown in FIG. 19 and an operation for detaching the photoconductor 103 from the photoconductor toner unit 105 is performed as shown in FIG. 20.

In this manner, it is possible to detach photoconductor toner unit 105 in substantially the same status and position when installed on the development device 108 in the image station 200, place the photoconductor toner unit 105 on the operation desk in substantially the same position, and perform the operation for replacing the photoconductor 103 in substantially the same position in order to improve efficiency of the replacement operation and prevent scattering or leakage of toner as much as possible.

Figure 21:
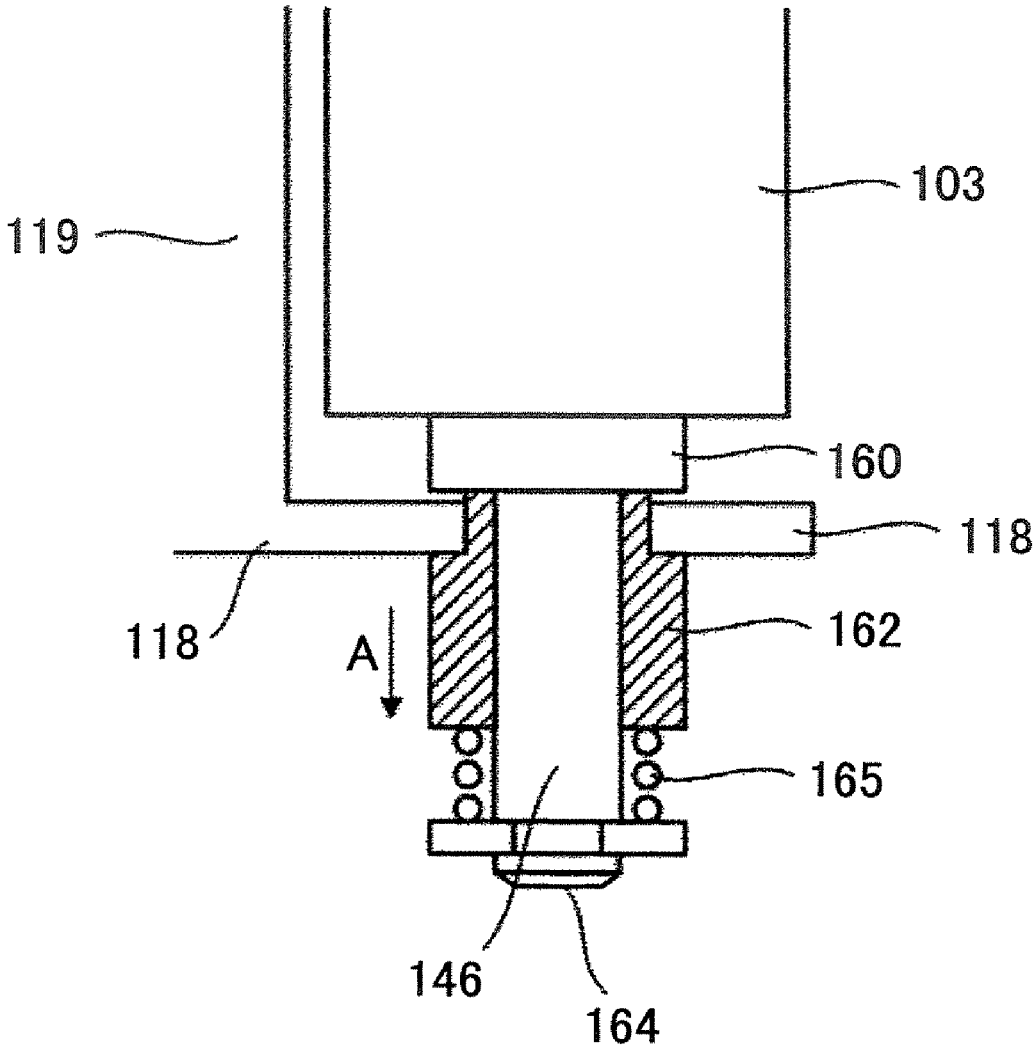
FIG. 21 is a partial cross-sectional view showing a schematic structure of a photoconductor attachment/detachment unit enabling attachment/detachment of a photoconductor relative to a photoconductor toner unit.

Next, FIG. 21 is a partial cross-sectional view showing a schematic structure of a photoconductor attachment/detachment unit enabling attachment/detachment of a photoconductor relative to the photoconductor toner unit. In FIG. 21, the photoconductor 103 is rotatably positioned in the holder unit 118 by pressing a bearing 162 on the holder unit 118 from outside using a spring. When the photoconductor 103 is detached, the bearing 162 is detached from the holder unit 118 by pulling the bearing 162 in A direction indicated by an arrow and the photoconductor 103 is pulled out upward while a rotation shaft 164 is moved along a slit groove 163 of the holder unit 118. In this case, a spring 165 and the bearing 162 are detached along with the photoconductor 103. Installation of the photoconductor 103 on the photoconductor toner unit 105 and installation of the photoconductor toner unit 105 on the development device 108 in the image station 200 are conducted by reversely performing the above-mentioned detachment procedure. As mentioned above, in the present embodiment, an installation and detachment direction of the photoconductor toner unit 105 relative to the development device 108 and an installation and detachment direction of the photoconductor 103 relative to the photoconductor toner unit 105 in the image station 200 are the upward direction. The installation and detachment direction varies in each apparatus form and is not particularly limited. However, by performing each installation and detachment in the same direction, directions upon operation are determined to be the same direction and movement of operation such as movement of the hand, for example, necessary for installation and detachment is limited to be upward and downward movement, for example, which is readily understandable for the user, so that it is possible to provide an efficient method for installation and detachment operation. Further, as shown in FIG. 20, a structure and shape of the housing 119 is determined such that no element is disposed in a space area where the photoconductor 103 is moved upon installing and detaching the photoconductor 103 so as not to hinder the installation and detachment operations upon installing and detaching the photoconductor 103 or damage the photoconductor 103. In particular, the toner storage unit 104 preferably has a large capacity as much as possible. However, if a size of the toner storage unit 104 is increased to the installation and detachment area of the photoconductor 103 as in the photoconductor toner unit 105, it is impossible to pull out the photoconductor 103 in the upward direction, so that neither installation nor detachment is possible. In view of this, the upper portion of the toner storage unit 104 is determined such that neither installation nor detachment is hindered as in the housing 119 in FIG. 20. When the size of the toner storage unit 104 is required to be increased, a portion other than the space area necessary for the photoconductor 103 to be installed or detached is increased. Moreover, in the present embodiment, the upper right end of the holder unit 118 is configured to have a structure or shape so as to not to include the installation and detachment area of the photoconductor 103.

Figure 22:
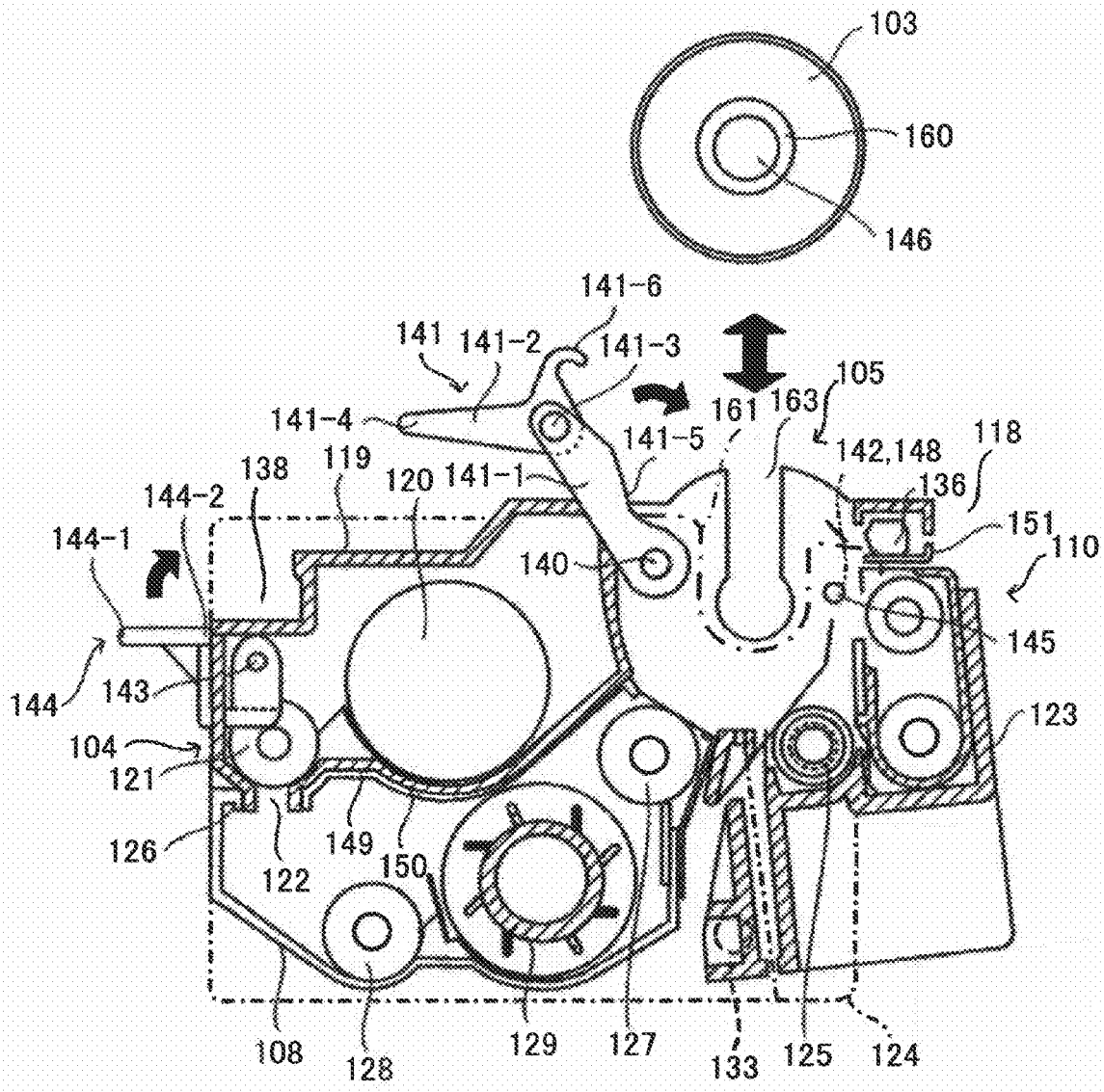
FIG. 22 is a schematic cross-sectional view showing an operation for detaching a photoconductor while a photoconductor toner unit is installed on an image station.

FIG. 22 is a schematic cross-sectional view showing an operation for detaching the photoconductor while the photoconductor toner unit in FIGS. 17 to 20 is installed on an image station in FIG. 13. The replacement operation of the photoconductor 103 in the photoconductor toner unit 105 in FIGS. 17 to 20 is performed after the photoconductor toner unit 105 is detached form the development device 108 in the image station 200. However, this operational step is omitted in the development device 108 in the image station 200 shown in FIG. 22 and the photoconductor 103 is directly replaced while the photoconductor toner unit 105 is installed, so that it is possible to further improve the replacement operation. In FIG. 22, of the lever 141 and the lever 144 as lock units for the photoconductor toner unit 105, only a lock of the lever 141 is released and a locking status of the lever 144 is maintained. When the locking status of the lever 144 is maintained, it is possible to securely fix the photoconductor toner unit 105 on the side plate 124 in the image station 200 to some extent and to maintain the position of the photoconductor toner unit 105. In this status, it is possible to install and detach the photoconductor 103, so that it is possible to replace the photoconductor 103 while the photoconductor toner unit 105 is installed on the side plate 124 in the image station 200. Further, in such a structure, for example, after the above-mentioned photoconductor 103 is solely detached, even if the photoconductor toner unit 105 without the photoconductor 103, namely, the housing 119 is required to be detached from the development device 108 in the image station 200 for some reason, it is possible to detach by merely releasing the lock of the lever 144.

Figure 23:
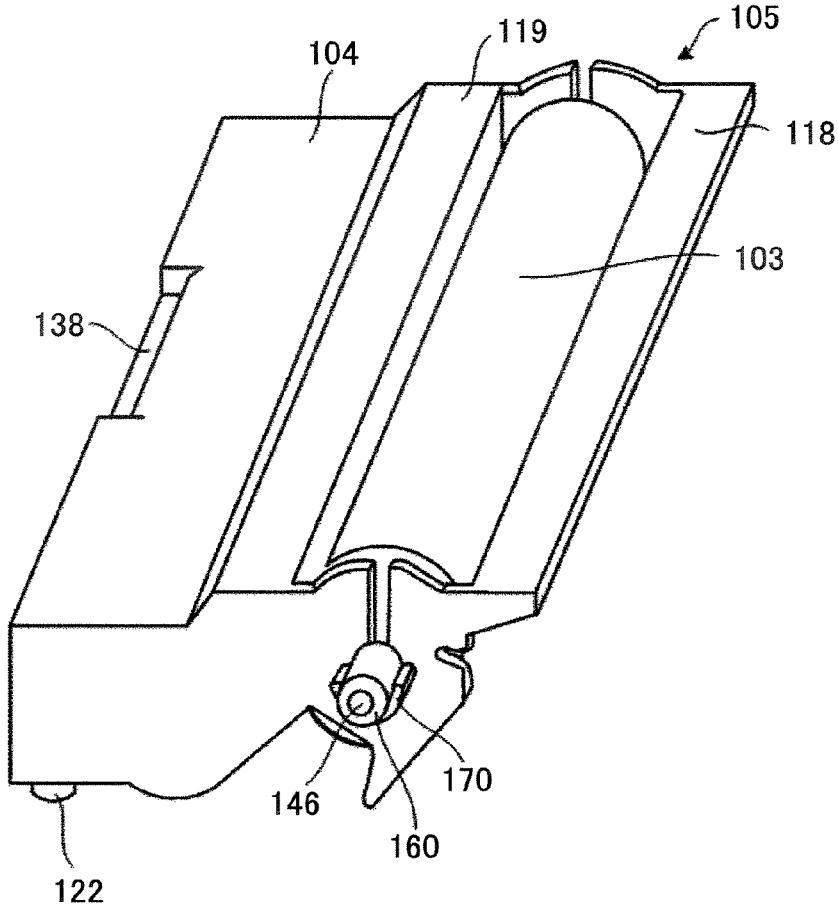
FIG. 23 is a schematic perspective view showing a structure in which a photoconductor toner unit is more firmly attached to a side plate of an image station.
Figure 24:
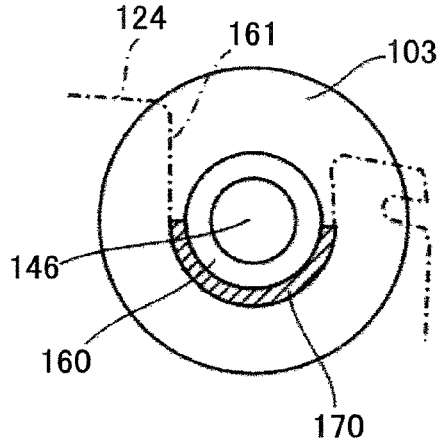
FIG. 24 is a schematic cross-sectional view showing a structure in which a photoconductor toner unit is more firmly attached to a side plate of an image station.

Further, as shown in FIGS. 23 and 24, a semicircular collar 170 protruding on an outer side face of the holder unit 118 of the photoconductor toner unit 105 is formed so as to reinforce the installation of the photoconductor toner unit 105 relative to the side plate 124 in the image station 200 upon replacing the photoconductor 103 while the photoconductor toner unit 105 is installed on the image station 200. A center of the semicircular collar 170 is concentric with the rotation shaft 164 of the photoconductor 103 and with a semicircular portion of the U-shaped groove portion 161 of the side plate 124. An inside diameter of the semicircular collar 170 is the same as an outside diameter of the bearing 162 and the outside diameter of the semicircular collar 170 is the same as a diameter of the U-shaped groove portion 161. In other words, the photoconductor 103 and the side plate 124 of the image station 200 are positioned by the semicircular collar 170 and each relationship of relative position is determined. In FIG. 22, when the photoconductor 103 is replaced, the photoconductor toner unit 105 is cantilevered by the lock of the lever 144 and the holder unit 118 may be vibrated to some extent. According to the semicircular collar 170 even when the photoconductor 103 (including the bearing 162) is detached from the photoconductor toner unit 105, it is possible to position the semicircular collar 170 on the U-shaped groove portion 161 and firmly support the holder unit 118. In other words, in the photoconductor toner unit 105, even when the photoconductor 103 is detached, the holder unit 118 is supported on the side plate 124 in the image station 200 by the semicircular collar 170 and the toner storage unit 104 is fixed by the lever 144, so that vibration is eliminated. In addition, the toner storage unit 104 is pressed on the development device 108 using the lever 144, so that the bottom 149 of the toner storage unit 104 is brought into abutment with the top face 150 of the development device 108, since it is necessary to determine the positioning in the upward and downward directions in FIG. 22.

Figure 25:
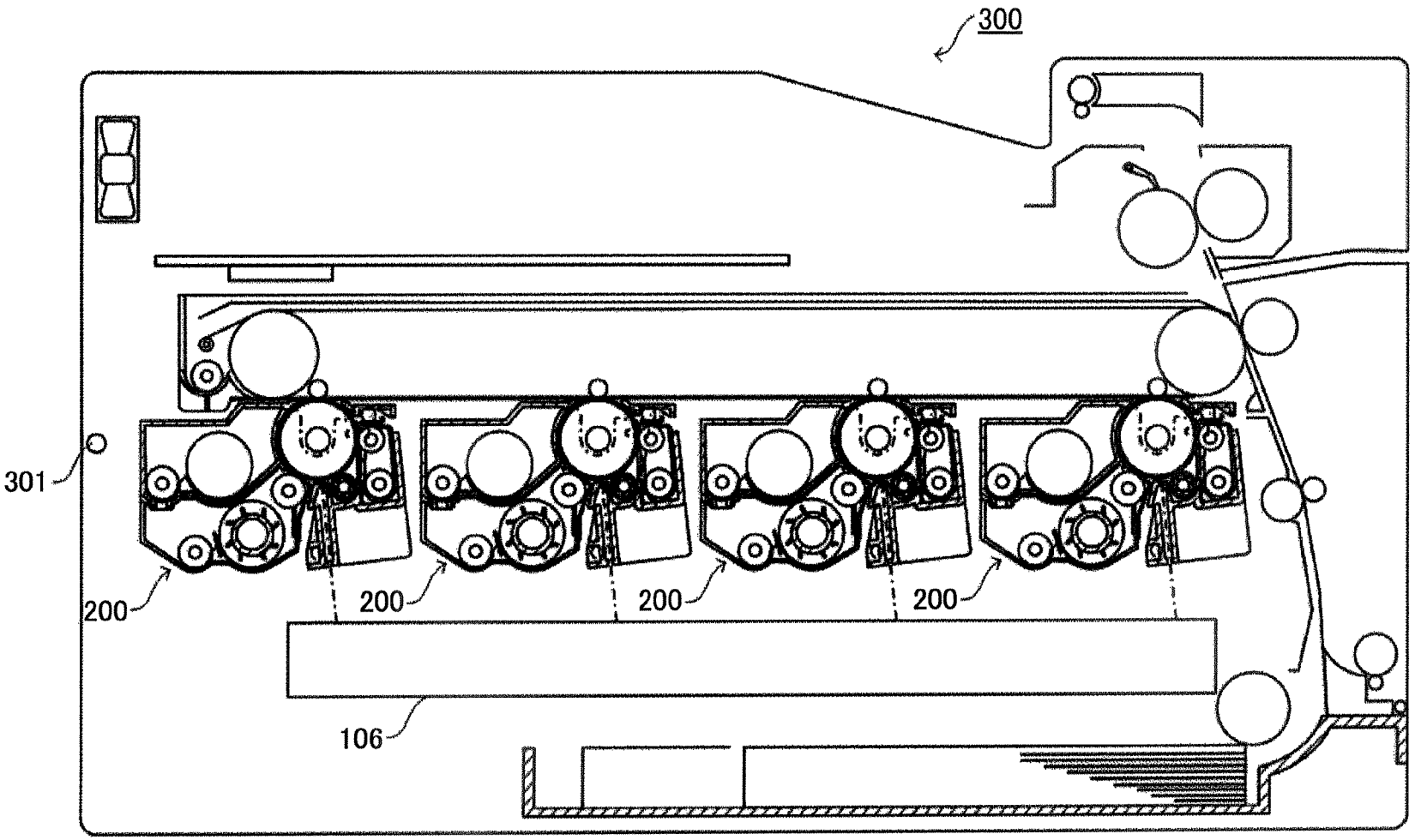
FIG. 25 is a schematic cross-sectional view showing an example of a color-image forming apparatus.

As mentioned above, the example is described based on the case where the photoconductor toner unit 105 and the image station 200 of the present invention are installed on a monochrome image forming apparatus. However, as shown in FIG. 25 as an example of a color image forming apparatus, a color image forming apparatus 300 may be formed by disposing plural photoconductor toner units 105 and image stations 200 and storing different colors in toner storage units. In this case, with the passage of time, a difference of degree of consumption is generated in the photoconductors or toner in each color and a difference of life of cleaning units is generated, and unexpected failure may be generated. Thus, preferably, it is possible to solely detach each image station of each color in terms of reduction of running costs.

In the case of the image forming apparatus 300 shown in FIG. 25, it is possible to provide a color image forming apparatus with improved usability and operability in the same manner as in the above-mentioned embodiment of a monochrome image forming apparatus by constructing the image forming apparatus 300 such that an upper side including an intermediate transfer belt unit is defined as an upper enclosure and a lower side including the plural photoconductor toner units 105 is defined as a lower enclosure by the photoconductor toner unit 105 as a boundary, the photoconductor toner unit 105 being parallely arranged with the intermediate transfer belt unit, and the upper enclosure is rotated on a fulcrum 301 so as to be opened in a door-like manner, the fulcrum 301 being disposed on a left end of a body of the image forming apparatus.

The present invention is not limited to the specifically disclosed embodiment, and variations and modifications may be made without departing from the scope of the present invention.

The present application is based on Japanese priority application No. 2006-000467 filed Jan. 5, 2006, Japanese priority application No. 2006-144106 filed May 24, 2006, and Japanese priority application No. 2006-174771 filed Jun. 26, 2006, the entire contents of which are hereby incorporated herein by reference.

What is claimed is:

1. An image carrier toner unit comprising:

an image carrier;

a supporting member configured to be integrated with the image carrier, the supporting member supporting the image carrier; and a toner storage unit configured to be integrally molded with the supporting member, the toner storage unit storing toner for developing a latent image on the image carrier as a visible image, wherein the image carrier toner unit is detachably attached to a device on which the image carrier toner unit is installed, wherein a time when toner stored in the toner storage unit is completely consumed from image forming and a time when life of the image carrier is ended are substantially the same by comparison or the life of the image carrier is longer.

2. An image carrier toner unit comprising:

an image carrier;

a supporting member for rotatably supporting the image carrier; and a toner storage unit supplying toner to a development unit forming a latent image on the image carrier as a visible image, wherein the image carrier toner unit is capable of being positioned, fixed, and detached relative to a device on which the image carrier toner unit is installed, at least three positioning and fixing portions are disposed for the device on which the image carrier toner unit is installed, and two of the positioning and fixing portions are disposed on the image carrier and at least one of the positioning and fixing portions is disposed on the toner storing unit.

3. An image carrier toner unit comprising:

an image carrier;

a supporting member for rotatably supporting the image carrier; and a toner storage unit supplying toner to a development unit forming a latent image on the image carrier as a visible image, wherein the image carrier toner unit is capable of being positioned, fixed, and detached relative to a device on which the image carrier toner unit is installed and the image carrier is capable of being positioned, fixed, and detached relative to the image carrier toner unit, and a portion is provided such that a base portion of installation for the image carrier and a base portion of installation for the device are disposed on the same location.

4. The image carrier toner unit according to claim 3, wherein a detachment direction of the image carrier toner unit detached relative to the device on which the image carrier toner unit is installed is substantially the same as a detachment direction of the image carrier detached relative to the image carrier toner unit.

5. The image carrier toner unit according to claim 3, wherein the image carrier is detachable while the image carrier toner unit is positioned and fixed on the device.

6. The image carrier toner unit according to claim 3, wherein the image carrier toner unit when the image carrier is detached is detachably attached to the device.

7. The image carrier toner unit according to claim 3, wherein the base portion of installation for the device is disposed on the image carrier and the toner storage unit.

8. An image forming apparatus on which an image carrier toner unit is installed, wherein the image carrier toner unit comprises:

an image carrier;

a supporting member configured to be integrated with the image carrier, the supporting member supporting the image carrier;

a toner storage unit configured to be integrally molded with the supporting member, the toner storage unit storing toner for developing a latent image on the image carrier as a visible image; and a development unit forming a toner image on the image carrier, wherein the toner storage unit of the image carrier toner unit is positioned above the development unit, and the image carrier toner unit is detachably attached to the image forming apparatus on which the image carrier toner unit is installed.

9. An image forming apparatus on which an image carrier toner unit is installed, wherein the image carrier toner unit comprises:

an image carrier;

a supporting member configured to be integrated with the image carrier, the supporting member supporting the image carrier; and a toner storage unit configured to be integrally molded with the supporting member, the toner storage unit storing toner for developing a latent image on the image carrier as a visible image, and the image carrier toner unit is detachably attached to the image forming apparatus on which the image carrier toner unit is installed, wherein a replacement time of the image carrier toner unit is determined in accordance with a time when toner of the toner storage unit of the image carrier toner unit is completely consumed.

10. An image forming apparatus on which an image carrier toner unit is installed, wherein the image carrier toner unit comprises:

an image carrier;

a supporting member for rotatably supporting the image carrier; and a toner storage unit supplying toner to a development unit forming a latent image on the image carrier as a visible image, wherein the image carrier toner unit is capable of being positioned, fixed, and detached relative to a device on which the image carrier toner unit is installed, at least three positioning and fixing portions are disposed for the device on which the image carrier toner unit is installed, and two of the positioning and fixing portions are disposed on the image carrier and at least one of the positioning and fixing portions is disposed on the toner storing unit, and the image carrier toner unit is detachably attached to a device on which the image carrier toner unit is installed.

11. The image forming apparatus according to claim 10, including a development unit forming a toner image on the image carrier, wherein the toner storage unit of the image carrier toner unit is positioned above the development unit.

12. The image forming apparatus according to claim 10, wherein the image carrier toner unit is capable of being detached upward.

13. The image forming apparatus according to claim 10, wherein a replacement time of the image carrier toner unit is determined in accordance with a time when toner of the toner storage unit of the image carrier toner unit is completely consumed.

14. The image forming apparatus according to claim 10, wherein among constituent elements of imaging units constituting the image forming apparatus, the image carrier toner unit is capable of being detached first.

15. An image forming apparatus on which an image carrier toner unit is installed, wherein the image carrier toner unit comprising:

an image carrier;

a supporting member for rotatably supporting the image carrier; and a toner storage unit supplying toner to a development unit forming a latent image on the image carrier as a visible image, wherein the image carrier toner unit is capable of being positioned, fixed, and detached relative to a device on which the image carrier toner unit is installed and the image carrier is capable of being positioned, fixed, and detached relative to the image carrier toner unit, a portion is provided such that a base portion of installation for the image carrier and a base portion of installation for the device are disposed on the same location, and the image carrier toner unit is detachably attached to a device on which the image carrier toner unit is installed.

16. The image forming apparatus according to claim 15, including a development unit forming a toner image on the image carrier, wherein the toner storage unit of the image carrier toner unit is positioned above the development unit.

17. The image forming apparatus according to claim 15, wherein the image carrier toner unit is capable of being detached upward.

18. The image forming apparatus according to claim 15, wherein a replacement time of the image carrier toner unit is determined in accordance with a time when toner of the toner storage unit of the image carrier toner unit is completely consumed.

19. The image forming apparatus according to claim 15, wherein among constituent elements of imaging units constituting the image forming apparatus, the image carrier toner unit is capable of being detached first.

* * * * *